US012780467B2

(12) United States Patent
Pena et al.

(10) Patent No.: US 12,780,467 B2
(45) Date of Patent: Nov. 3, 2026

(54) METHOD AND SYSTEM FOR FORMING A PACKAGE

(71) Applicant: Graphic Packaging International, LLC, Atlanta, GA (US)

(72) Inventors: Carlos Molina Pena, Atlanta, GA (US); Nicholas Evans, Canton, GA (US); John Pate, Snellville, GA (US); Miguel Lopez, Rome, GA (US); Ainsworth Wright, Palmetto, GA (US); Clifton R. Howell, White, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 19/375,468

(22) Filed: Oct. 31, 2025

(65) Prior Publication Data

US 2026/0125169 A1 May 7, 2026

Related U.S. Application Data

(60) Provisional application No. 63/715,028, filed on Nov. 1, 2024, provisional application No. 63/714,935, filed on Nov. 1, 2024.

(51) Int. Cl.
*B65B 17/02* (2006.01)
*B65B 21/24* (2006.01)
(Continued)

(52) U.S. Cl.
CPC ..... *B65B 17/025* (2013.01); *B65B 21/242* (2013.01); *B65B 43/10* (2013.01);
(Continued)

(58) Field of Classification Search
CPC ... B65B 17/025; B65B 11/004; B65B 21/242; B65B 43/10; B65B 43/24; B65B 49/08; B65B 35/44; B65B 49/04; B65B 65/003
See application file for complete search history.

(56) References Cited

U.S. PATENT DOCUMENTS 1,527,399 A 2/1925 Davidson
1,787,116 A * 12/1930 Marasso ..... B65B 49/12
53/371.4
(Continued)

FOREIGN PATENT DOCUMENTS

CN 114560135 A 5/2022
EP 240126 A2 10/1987
(Continued)

OTHER PUBLICATIONS

International Search Report and Written Opinion issued in App. No. PCT/US2025/053464 dated Mar. 18, 2026 (pp. 1-10).
(Continued)

*Primary Examiner* — Dariush Seif
(74) *Attorney, Agent, or Firm* — Andrew N. Claerbout; FisherBroyles, LLP

(57) ABSTRACT

A method and system for forming a package that addresses operational challenges in container packaging systems. The system may include a conveyor to propagate the blank and the plurality of containers at a first velocity through the system, the blank includes a main panel having a plurality of apertures, a left clip enclosing panel foldably coupled to a first side of the main panel and a right clip enclosing panel foldably coupled to a second side of the main panel. The system further includes a latching tool including a blade member configured to travel in an eccentric path such that the blade member is arranged to move vertically to secure a portion of the clip enclosing panel to a first set of containers while simultaneously moving horizontally at the first velocity.

30 Claims, 13 Drawing Sheets

(51) Int. Cl.

| | |
|---|---|
| ***B65B 35/44*** | (2006.01) |
| ***B65B 43/10*** | (2006.01) |
| ***B65B 43/24*** | (2006.01) |
| ***B65B 49/04*** | (2006.01) |
| ***B65B 49/08*** | (2006.01) |
| ***B65B 65/00*** | (2006.01) |

(52) U.S. Cl.

CPC ..... *B65B 49/08* (2013.01); *B65B 35/44* (2013.01); *B65B 43/24* (2013.01); *B65B 49/04* (2013.01); *B65B 65/003* (2013.01)

(56) References Cited

U.S. PATENT DOCUMENTS 2,111,621 A 3/1938 Gerking
2,289,859 A 7/1942 Arthur
2,522,950 A 9/1950 Keith
2,575,654 A 11/1951 Casler
2,726,583 A 12/1955 Barnes
2,798,603 A 7/1957 Grinspoon
2,950,041 A 8/1960 Stone
3,022,615 A 2/1962 Schroeder
3,061,985 A * 11/1962 Ganz ..... B65B 11/105 53/48.9
3,065,679 A 11/1962 Clement
3,073,440 A 1/1963 Floyd
3,303,631 A * 2/1967 Ganz ..... B65B 21/24 53/48.9
3,364,826 A 1/1968 Austin, Jr.
3,474,590 A 10/1969 Ganz
3,528,697 A 9/1970 Wood
3,599,776 A 8/1971 Babunovic
3,643,796 A * 2/1972 Arneson ..... B65B 17/025 206/158
3,648,573 A 3/1972 Le Febvre
3,681,893 A * 8/1972 De Barge ..... B65B 7/20 53/209
3,698,151 A * 10/1972 Arneson ..... B65B 21/242 53/448
3,745,892 A * 7/1973 Ganz ..... B65B 43/24 493/454
3,760,554 A * 9/1973 Arneson ..... B65B 17/025 53/49
3,800,677 A 4/1974 Jones
3,878,665 A * 4/1975 Couten ..... B65B 21/025 53/247
3,897,873 A 8/1975 Graser
3,940,907 A 3/1976 Ganz
3,942,631 A 3/1976 Sutherland
3,952,634 A 4/1976 Rollins
4,024,693 A 5/1977 Leasure
4,028,999 A 6/1977 Lee
4,029,204 A 6/1977 Manizza
4,079,663 A 3/1978 Heller
4,096,985 A 6/1978 Wood
4,100,715 A 7/1978 Ganz
4,121,506 A 10/1978 Van Grouw
4,123,966 A 11/1978 Buschor
4,164,171 A 8/1979 Gorshe
4,188,766 A * 2/1980 Culpepper ..... B65B 17/025 53/48.5
4,190,149 A 2/1980 Oliff
4,192,540 A 3/1980 Oliff
4,213,283 A * 7/1980 Calvert ..... B65B 17/025 53/134.1
4,287,699 A * 9/1981 Hart ..... B65B 17/025 53/48.5
4,304,329 A 12/1981 Graser
4,372,599 A 2/1983 Kiedaisch
4,378,878 A 4/1983 Graser
4,378,879 A 4/1983 Killy
4,382,505 A 5/1983 Sutherland
4,386,699 A 6/1983 Sutherland
4,403,689 A 9/1983 Wood
4,460,349 A * 7/1984 Charron ..... B31B 50/30 493/131
4,465,180 A 8/1984 Klygis
4,548,021 A 10/1985 Bader
4,554,778 A * 11/1985 Calvert ..... B65B 21/24 53/48.9
4,562,687 A * 1/1986 Green, Jr. ..... B65B 5/026 53/376.5
4,563,853 A * 1/1986 Calvert ..... B65B 21/24 53/381.2
4,582,552 A 4/1986 Fitzgibbon
4,619,637 A 10/1986 Jones
4,624,096 A * 11/1986 Nordstrom ..... B65B 51/16 53/590
4,646,508 A * 3/1987 Focke ..... B65B 11/004 53/234
4,646,917 A 3/1987 Schuster
4,681,217 A 7/1987 Hernandez
4,736,977 A 4/1988 Killy
4,784,266 A 11/1988 Chaussadas
4,941,624 A 7/1990 Schuster
5,131,208 A 7/1992 Paul
5,139,147 A 8/1992 Sutherland
5,163,548 A 11/1992 Domansky
5,177,930 A 1/1993 Harston
5,188,225 A 2/1993 Jorba
5,201,412 A 4/1993 Schuster
5,267,644 A 12/1993 Tsao
5,273,156 A 12/1993 Harris
5,282,348 A * 2/1994 Dampier ..... B65D 71/42 53/413
5,297,673 A 3/1994 Sutherland
5,310,050 A 5/1994 Sutherland
5,310,051 A 5/1994 Sutherland
5,311,994 A 5/1994 Oliff
5,314,224 A 5/1994 Bates
5,323,895 A 6/1994 Sutherland
5,328,024 A 7/1994 Sutherland
5,344,006 A 9/1994 Mazzeo
5,351,815 A 10/1994 Fogle
5,351,816 A 10/1994 Sutherland
5,351,817 A 10/1994 Sutherland
5,355,999 A 10/1994 Sutherland
5,359,830 A * 11/1994 Olson ..... B65B 17/025 53/134.1
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,469,687 A * 11/1995 Olson ..... B65B 17/025 53/134.1
5,474,172 A 12/1995 Zavatone
5,501,335 A 3/1996 Harris
5,503,267 A 4/1996 Sutherland
5,520,283 A 5/1996 Sutherland
5,524,756 A 6/1996 Sutherland
5,537,801 A * 7/1996 Granbakken ..... B65B 17/025 53/134.1
5,551,566 A 9/1996 Sutherland
5,582,289 A 12/1996 Wright
5,590,776 A 1/1997 Galbierz
5,593,027 A 1/1997 Sutherland
5,626,002 A 5/1997 Ford
5,638,659 A 6/1997 Moncrief
5,639,017 A 6/1997 Fogle
5,653,084 A * 8/1997 Mueller ..... B65B 11/105 53/48.8
5,673,536 A * 10/1997 Easter ..... B65B 49/12 53/48.8
5,724,785 A 3/1998 Malanowski
5,735,394 A 4/1998 Harrelson
5,746,310 A 5/1998 Slomski
5,791,463 A 8/1998 Negelen
5,794,778 A 8/1998 Harris
5,809,746 A 9/1998 Depuy

(56) References Cited

U.S. PATENT DOCUMENTS 5,816,391 A 10/1998 Harris
5,871,090 A 2/1999 Doucette
5,873,515 A 2/1999 Dunn
5,915,546 A 6/1999 Harrelson
5,921,392 A 7/1999 Davis
5,944,174 A * 8/1999 Marco ..... B65D 71/504 206/148
5,960,945 A 10/1999 Sutherland
5,979,147 A 11/1999 Reuteler
5,979,747 A 11/1999 Gnadt
5,992,733 A 11/1999 Gomes
6,042,527 A 3/2000 Anderson
6,059,099 A 5/2000 Galbierz
6,065,590 A 5/2000 Spivey
6,282,864 B1 9/2001 Jaenen
6,315,111 B1 11/2001 Sutherland
6,484,903 B2 11/2002 Spivey
6,550,608 B1 4/2003 Brown
6,732,489 B1 * 5/2004 Hawley ..... B65B 21/24 53/48.8
6,779,655 B2 8/2004 Olsen
6,896,130 B2 5/2005 Theelen
6,926,193 B2 8/2005 Smalley
7,011,209 B2 3/2006 Sutherland
7,721,878 B2 5/2010 Requena
7,823,721 B2 11/2010 Sutherland
8,353,398 B2 1/2013 Depaula
9,284,090 B2 * 3/2016 Lettre ..... B65D 5/48024
9,573,710 B2 * 2/2017 Hendricks ..... B65B 41/04
9,776,750 B2 10/2017 May
10,087,008 B2 10/2018 Mattioli
10,093,484 B2 * 10/2018 Mattioli ..... B65G 15/44
10,807,807 B2 10/2020 Ziegler
11,053,086 B2 7/2021 Ziegler
11,167,870 B2 * 11/2021 Karst ..... B65B 43/145
11,225,384 B2 * 1/2022 Karst ..... B65B 65/02
12,623,803 B1 * 5/2026 Dillon ..... B65B 47/04
2002/0195371 A1 12/2002 Brown
2003/0080004 A1 5/2003 Olsen
2003/0111362 A1 6/2003 Sutherland
2003/0213705 A1 11/2003 Woog
2005/0127151 A1 6/2005 Johnson
2005/0229538 A1 * 10/2005 Dall' Omo ..... B65B 11/22 53/134.1
2006/0154791 A1 7/2006 Reuteler
2007/0029371 A1 2/2007 Theelen
2007/0164091 A1 7/2007 Fogle
2007/0181658 A1 8/2007 Sutherland
2007/0240381 A1 10/2007 Alfonso
2009/0101526 A1 4/2009 Sutherland
2009/0127147 A1 5/2009 Sutherland
2009/0250357 A1 10/2009 Spivey, Sr.
2010/0078337 A1 4/2010 Sutherland
2010/0264043 A1 10/2010 De Paula
2011/0000799 A1 1/2011 Gonzalez
2011/0284623 A1 * 11/2011 Jones ..... B65B 21/242 206/427
2013/0042580 A1 * 2/2013 May ..... B65B 21/24 53/457
2013/0111855 A1 * 5/2013 Hendricks ..... B65B 41/08 53/235
2016/0039586 A1 * 2/2016 Merzeau ..... B65D 71/30 206/427
2020/0189821 A1 * 6/2020 Smalley ..... B65D 71/44
2020/0369420 A1 * 11/2020 Bonnain ..... B65B 11/105
2021/0331819 A1 * 10/2021 Ford ..... B65B 17/025
2022/0348368 A1 * 11/2022 Frederick ..... B65B 17/025
2022/0396407 A1 * 12/2022 Thompson ..... B65B 17/025
2023/0025633 A1 * 1/2023 Preihs ..... B65B 43/10
2023/0101990 A1 * 3/2023 Ford ..... B31D 5/04 493/88
2023/0391524 A1 * 12/2023 Mills ..... B65D 65/24
2023/0406589 A1 * 12/2023 Merzeau ..... B65B 17/025
2024/0199259 A1 * 6/2024 Bonnain ..... B65B 17/025
2024/0253883 A1 * 8/2024 Wimmer ..... B65B 17/025
2024/0409258 A1 * 12/2024 Martini ..... B65D 71/42
2025/0033312 A1 * 1/2025 Ford ..... B31F 1/0016
2025/0074638 A1 * 3/2025 Ford ..... B65B 17/025
2025/0368367 A1 * 12/2025 Wimmer ..... B65B 17/025
2026/0077898 A1 * 3/2026 Manneux ..... B65B 43/185
2026/0125169 A1 * 5/2026 Pena ..... B65B 17/025
2026/0125170 A1 5/2026 Pena

FOREIGN PATENT DOCUMENTS

EP 0242992 A2 10/1987
EP 0425135 A2 5/1991
EP 0428354 A1 5/1991
EP 2085314 A2 8/2009
EP 2744712 B1 10/2016
GB 1182022 A 2/1970
GB 2238285 A 5/1991
GB 2321229 A 7/1998
JP H03148459 A 6/1991
JP H03176374 A 7/1991
JP H06211212 A 8/1994
JP H08509944 A 10/1996
JP H11511104 A 9/1999
JP 2003146359 A 5/2003
JP 2003300554 A 10/2003
JP 2005500213 A 1/2005
JP 2007008475 A 1/2007
JP 2011502905 A 1/2011
WO 9406684 A1 3/1994
WO 9422738 A1 10/1994
WO 9501289 A1 1/1995
WO 9523091 A1 8/1995
WO 9523745 A1 9/1995
WO 2009064951 A2 5/2009
WO 2011075626 A2 6/2011

OTHER PUBLICATIONS

International Search Report and Written Opinion issued in App. No. PCT/US2025/053465 dated Mar. 17, 2026 (pp. 1-10).

* cited by examiner

FIG. 10A
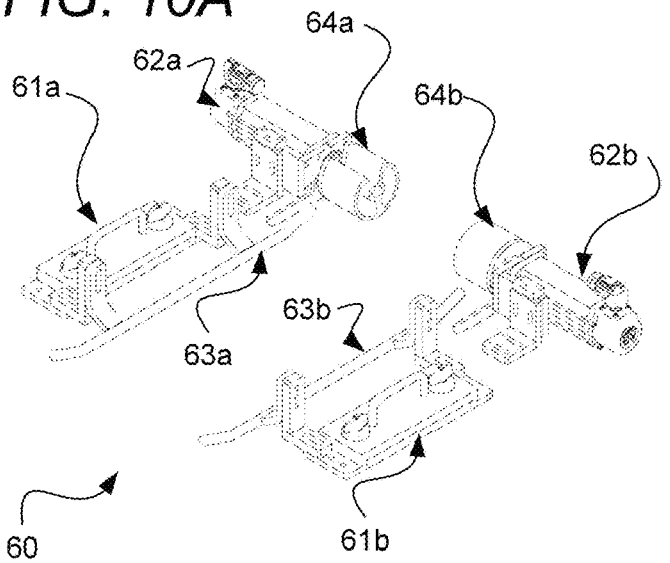
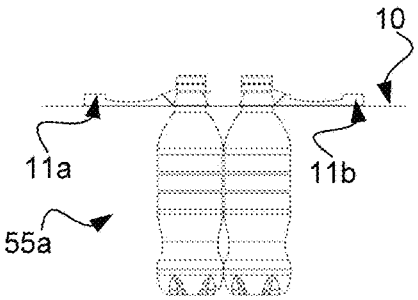
FIG. 11A
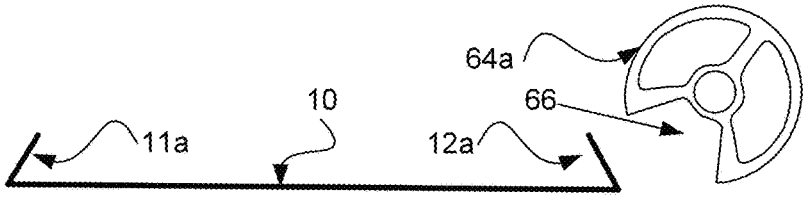
FIG. 12A
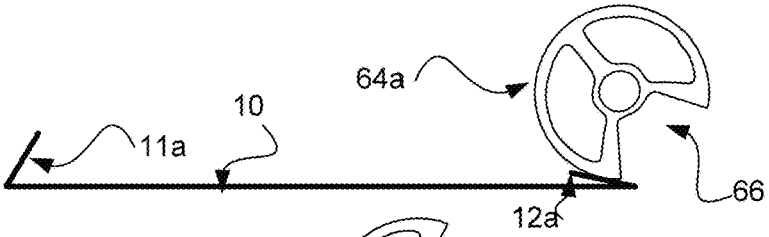
FIG. 12B
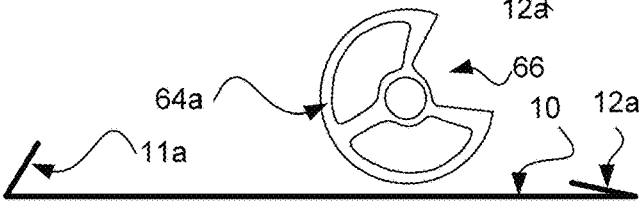
FIG. 12C
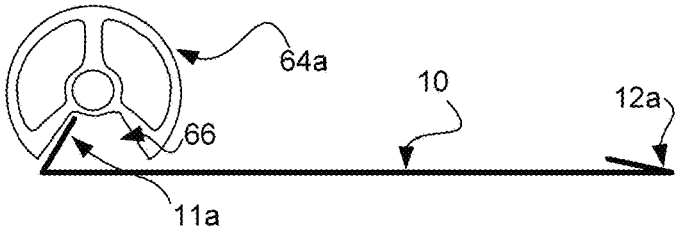
FIG. 12D
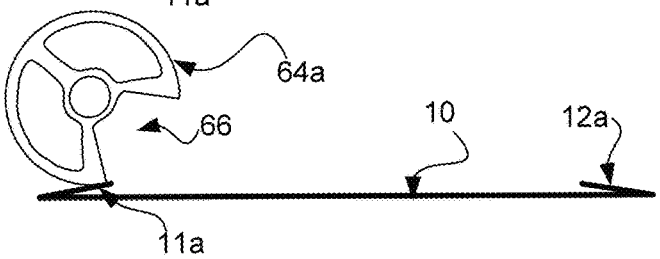
FIG. 12E

METHOD AND SYSTEM FOR FORMING A PACKAGE

CROSS-REFERENCE TO RELATED APPLICATION

The present application claims priority to U.S. Provisional Patent Application No. 63/714,935 entitled "METHOD AND SYSTEM FOR FORMING A PACKAGE" filed Nov. 1, 2024 and to U.S. Provisional Patent Application No. 63/715,028 entitled "METHOD AND SYSTEM FOR FORMING A PACKAGE" also filed Nov. 1, 2024.

INCORPORATION BY REFERENCE

The disclosure of U.S. Provisional Patent Application No. 63/714,935 entitled "METHOD AND SYSTEM FOR FORMING A PACKAGE" filed Nov. 1, 2024, is hereby incorporated by reference for all purposes as if presented herein in its entirety. Additionally, the disclosure of U.S. Provisional Patent Application No. 63/715,028 entitled "METHOD AND SYSTEM FOR FORMING A PACKAGE" filed Nov. 1, 2024, is hereby incorporated by reference for all purposes as if presented herein in its entirety.

BACKGROUND

Container packaging systems may encounter a variety of operational challenges that impact efficiency and reliability in commercial applications. Instability and misalignment of containers during automated transport can create downstream processing problems, while floor space requirements for conventional equipment limit facility layout options and reduce overall manufacturing flexibility.

Existing packaging systems may struggle to maintain consistent container positioning, often resulting in separation of individual containers from their groups and disruptions to automated processing sequences. Conventional packaging methods also frequently fail to provide sufficient protection against impact damage during storage and shipping, leading to crushing, surface damage, and the need for manual intervention. High mechanical forces during folding and dynamic assembly operations may further reduce efficiency, accelerate equipment wear, and increase maintenance demands.

These operational shortcomings may drive increased labor requirements due to frequent manual adjustments or system stoppages. Inefficiencies in space utilization and transportation often result in higher storage and shipping expenses, expanded facility requirements, and increased supply chain costs. Frequent system downtime and component failures may interrupt production schedules, reduce throughput, and compound operational expenses, while unreliable packaging operations may also lead to product damage-related losses and additional quality assurance challenges.

As a result, conventional packaging system limitations may create broader negative impacts throughout the industry. These impacts may include increased environmental waste, inefficient warehouse utilization, production and distribution delays, and difficulties meeting modern supply chain demands for speed, flexibility, and compliance. Emerging requirements for sustainability, regulatory compliance, real-time operational visibility, and package customization continue to widen the performance gap between current market needs and the capabilities of existing packaging machinery.

SUMMARY OF THE DISCLOSURE

The disclosure relates to a method and system for forming a package that addresses operational challenges in container packaging systems. The system may include a specialized blank design for forming carriers and an automated machine system for assembling these blanks with beverage containers.

The automated packaging machine may include a conveyance system that provides continuous blank transport through multiple processing stages. The conveyance system may include motorized belt conveyors with drive wheels and guide rails for blank alignment. Support stanchions and anchors may provide structural stability for the system. Velocity control mechanisms may enable synchronized operation throughout the assembly process.

The system may include pre-break stages that prepare fold lines in the blank for subsequent folding operations. Leading edge manipulators may include mechanical elements with finger-like protrusions and biasing mechanisms for controlled pressure application. Trailing edge cam assemblies may include dynamic cams with engagement points mounted on rotatable shafts driven by servo motors. Tamper wheels may provide rolling surfaces with wedge-shaped recesses for secondary fold line reinforcement.

Progressive folding stages may transform the flat blank into a three-dimensional carrier structure. First stage plows may provide angled surfaces for initial cap enclosing panel folding. Second stage plows may include advanced folding mechanisms for continued panel shaping. Multi-stage plows may create sequential folding operations that form complex panel geometries. Mounting brackets and fixtures may provide component support throughout the folding process.

The clipping stage may secure the final assembly through dynamic engagement mechanisms. A dynamic guide system may include a belt-driven guide that matches blank propagation velocity. Static guides may provide fixed positioning elements for panel stabilization. Latching tools may include eccentric motion assemblies with blade members, articulated arms, and drive motors that create secure clip connections.

The blank may include a central panel that serves as the primary structural foundation. Container orifices in the central panel may receive containers through cap and neck engagement. Finger holder orifices may provide convenient lifting points for the completed package. Cap enclosing panels may be foldable panels with aligned orifices and reinforcing finger holder orifices. Edge tabs may provide structural support elements with pre-defined fold lines.

The method may begin with receiving a flat blank with partially engaged containers from a blank feeder. The conveyance system may maintain constant propagation velocity throughout all assembly stages. Pre-break operations may prepare fold lines through controlled bending of trailing edge tabs. Progressive folding may create sequential panel transformations from flat to complex three-dimensional configurations. The clipping process may secure panel sections under container neck regions through coordinated latching tool operations.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

FIGS. 10A-10E illustrate portions of the machine of FIG. 5 corresponding to the stages of assembly depicted in FIG. 6 without the blanks in the stages according to an embodiment of the subject matter disclosed herein.

FIGS. 11A-11E illustrate respective assembly stages of the blank as proceeding through the machine of FIG. 5 without the machine stage according to an embodiment of the subject matter disclosed herein.

FIGS. 12A-12E illustrate aspects of the operation of the tucker wheel of FIG. 10A in various stages of engagement with the blank according to an embodiment of the subject matter disclosed herein.

Corresponding parts are designated by corresponding reference numbers throughout the drawings.

DETAILED DESCRIPTION

Figure 1:
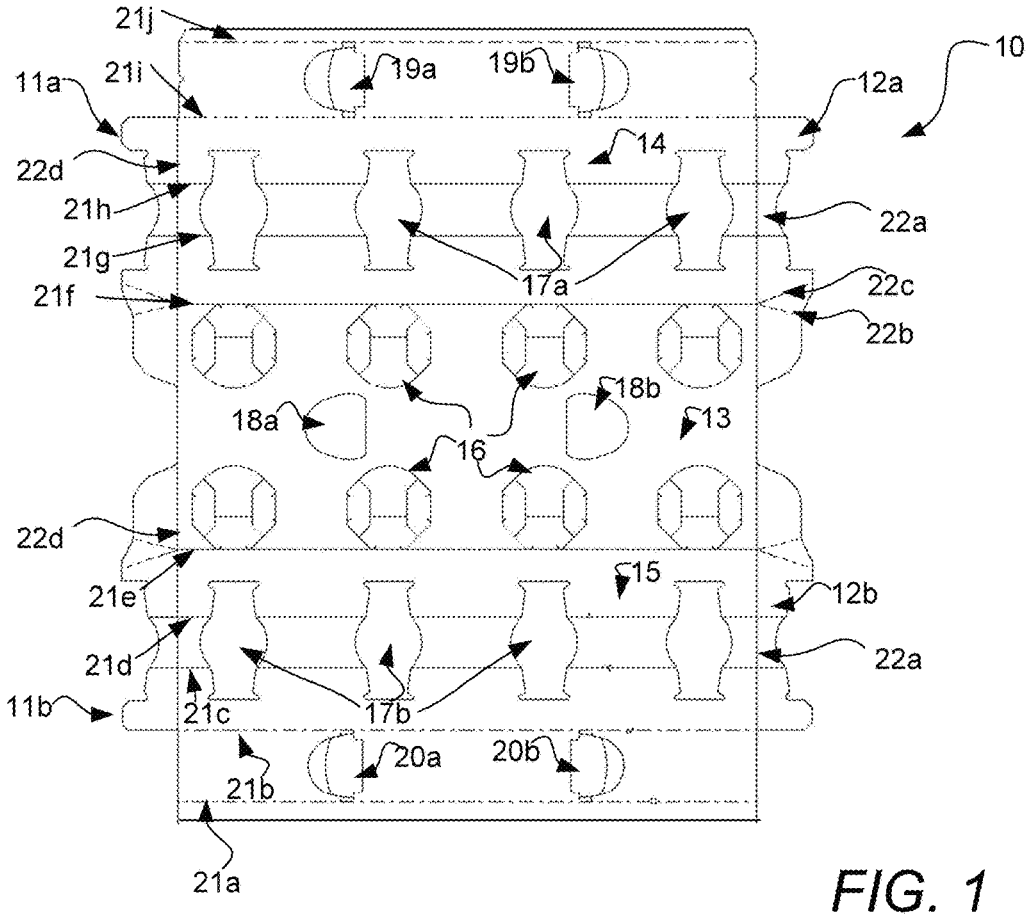
FIG. 1 illustrates a plan view of a blank for forming a carrier according to an embodiment of the subject matter disclosed herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Several illustrative embodiments will now be described with respect to the accompanying drawings, which form a part hereof. The ensuing description provides embodiment (s) only and is not intended to limit the scope, applicability, or configuration of the disclosure. Rather, the ensuing description of the embodiment(s) will provide those skilled in the art with an enabling description for implementing one or more embodiments. It is understood that various changes may be made in the function and arrangement of elements without departing from the spirit and scope of this disclosure. In the following description, for the purposes of explanation, specific details are set forth in order to provide a thorough understanding of certain inventive embodiments. However, it will be apparent that various embodiments may be practiced without these specific details. The figures and description are not intended to be restrictive. The word "example" or "exemplary" is used herein to mean "serving as an example, instance, or illustration." Any embodiment or design described herein as "exemplary" or "example" is not necessarily to be construed as preferred or advantageous over other embodiments or designs.

The present disclosure relates to packaging systems and methods for forming packages that include carriers engaged with articles. The system and method may be particularly suited for forming packages containing beverage containers, food containers, or other consumer products that require secure packaging and convenient handling. The articles may include containers of various shapes and sizes, such as plastic bottles, glass bottles, aluminum cans, or other cylindrical or non-cylindrical containers used for packaging beverages, food products, or other consumer goods.

The system may accommodate containers made from materials suitable for packaging particular food or beverage items. These materials may include various plastics such as polyethylene terephthalate (PET), low-density polyethylene (LDPE), linear low-density polyethylene (LLDPE), high-density polyethylene (HDPE), polypropylene (PP), polystyrene (PS), polyvinyl chloride (PVC), ethylene vinyl alcohol (EVOH), and nylon. The containers may also be constructed from glass, aluminum, other metals, or any combination of these materials. The carriers themselves may be constructed from paperboard having sufficient caliper to provide greater rigidity than ordinary paper. The carrier material may also include cardboard or other materials having properties suitable for enabling the carrier to function as described. The blank material may be coated with clay coating, which may then be printed with product information, advertising, or other images. The blanks may be coated with varnish to protect printed information and may include moisture barrier layers on either or both sides. The blanks may also be laminated to or coated with one or more sheet-like materials at selected panels or panel sections.

For purposes of this specification, certain orientation terminology may be used to describe the relative positions and movements of components within the system. The terms "downstream" and "upstream" refer to directions relative to the flow of materials through the packaging system, with downstream indicating the direction toward the completed package formation and upstream indicating the direction toward the initial material input. The terms "lower," "bottom," "upper," and "top" indicate orientations determined in relation to fully erected carriers in their intended use position. The terms "front," "back," "left," and "right" may be used to describe relative positions of components as viewed from a particular perspective within the system.

Throughout this specification, various panels, portions, tabs, flaps, fold lines, and other components of the constructs and carriers may be designated using relative terms such as "first," "second," "third," and so forth. These designations may be used in sequential or non-sequential reference to distinguish between similar components without implying any particular order of importance or operation unless specifically indicated. Similarly, the various plows, guides, and other system components may be designated with alphabetical or numerical identifiers to facilitate description of their respective functions and positions within the overall system configuration.

FIG. 1 illustrates a flat blank 10 according to an embodiment of the subject matter disclosed herein. The blank 10 may comprise a substantially planar sheet of material that may be configured to form a carrier for engaging with a plurality of articles. The blank 10 may include a central panel 13 that may serve as a primary structural element of the carrier. The central panel 13 may be positioned substantially in the center of the blank 10 and may provide a foundation for supporting the articles when the blank 10 may be formed into a carrier configuration.

The blank 10 may include a left cap enclosing panel 14 and a right cap enclosing panel 15 that may be positioned adjacent to the central panel 13. The left cap enclosing panel 14 may be connected to the central panel 13 along a fold line 21*f* that may allow the left cap enclosing panel 14 to be folded relative to the central panel 13. The right cap enclosing panel 15 may be similarly connected to the central panel 13 along another fold line 21*e* that may permit folding movement of the right cap enclosing panel 15.

The central panel 13 may include a plurality of container cap central panel orifices 16 that may be configured to receive a portion of a beverage container cap. The container cap central panel orifices 16 may be sized and shaped to accommodate the cap and/or neck regions of individual beverage containers when engaged with the blank 10. In this embodiment, there are eight orifices to accommodate eight beverage containers. In other embodiments (e.g., FIG. 3) there may be six orifices or any other suitable number. The orifices 16 may also include biasing flaps suited to be maneuvered within the opening of the orifice to slide over the top of the cap and/or neck regions and securing the container in the orifice when passing the cap and/or neck region threshold. Further, as will be illustrated in the figures below, the left cap enclosing panel 14 may also include a container cap left panel orifices 17*a* that may be positioned to align with respective beverage container caps and/or neck portions when the blank 10 is in an assembled configuration. Similarly, the right cap enclosing panel 15 may include container cap right panel orifices 17*b* that may similarly be positioned to receive or accommodate respective beverage container caps and/or neck portions when assembled.

The central panel 13 may further include a first central panel finger holder orifice 18*a* and a second central panel finger holder orifice 18*b*. The first and second central panel finger holder orifices 18*a* and 18*b* may be configured to provide a means for a person to lift the container with beverages engaged therein. That is, in one example, a person's thumb may engage the first central panel finger holder orifice 18*a* and the person's index finger may engage the central panel finger holder orifice 18*b* to carry the overall carrier and containers assembly.

To provide additional support and reinforcement for the finger holder orifices 18*a* and 18*b*, the left cap enclosing panel 14 may include a first left panel finger holder orifice 19*a* and a second left panel finger holder orifice 19*b*. When folded (e.g., assembled), the first left panel finger holder orifice 19*a* and a second left panel finger holder orifice 19*b* are disposed coincident with the central panel finger holder orifices 18*a* and 18*b*, respectively. Likewise, the right cap enclosing panel 15 may include a first left panel finger holder orifice 20*a* and a second left panel finger holder orifice 20*b*. When folded (e.g., assembled), the first left panel finger holder orifice 20*a* and a second left panel finger holder orifice 20*b* are disposed coincident with the central panel finger holder orifices 18*a* and 18*b*, respectively.

The blank 10 may include a left leading-edge tab 12*a* that may extend from one edge (e.g., a trailing edge) of the left cap enclosing panel 14. The left leading-edge tab 12*a* may be configured to provide structural support when the blank 10 is formed into a constructed carrier. Thus, fold lines 22*a*, 22*b*, and 22*c* facilitate folding the left leading-edge tab 12*a* to form a rectangular construct to provide support this edge of the left cap enclosing panel 14. The fold lines and associated panel contiguous with the folds line 22*b* and 22*c* may be folded and manipulated by other portions of the machine for assembly. Of particular interest in this disclosure, however, is the fold line 22*a* that may benefit from a pre-break procedure to assist proper additional folding and construction. Such a pre-break procedure for this left leading-edge tab 12*a* is discussed below with respect to FIG. 7.

The blank 10 may also include a right leading-edge tab 12*b* that may extend from an edge of the right cap enclosing panel 15 and may provide similar structural functionality (e.g., with fold lines similar to fold lines 22*a*, 22*b*, and 22*c*) to the right cap enclosing panel 15 when assembled.

The blank 10 may further include a left trailing-edge tab 11*a* and a right trailing-edge tab 11*b*. The left leading-edge tab 11*a* may be positioned at a trailing edge of the left cap enclosing panel 14 and is similarly configured with fold lines to form a construct to support the right cap enclosing panel 14. Likewise, the right trailing-edge tab 11*b* may be positioned at a trailing edge of the right cap enclosing panel 15 and is similarly configured with fold lines to form a construct to support the right cap enclosing panel 15. As before, the trailing-edge tabs 11*a* and 11*b* may benefit from a pre-break procedure to initially cause folding along fold line 22*d* so as to further facilitate follow-on construction. This trailing edge pre-break procedure is discussed below with respect to FIG. 8.

The blank 10 may include multiple additional fold lines that may facilitate the formation of the blank 10 into a three-dimensional carrier structure. A first fold line 21*f* may be positioned to define a boundary between the central panel 13 and the left cap enclosing panel 14 of the blank 10. A second fold line 21*e* may be positioned to allow folding movement between the central panel 13 and the right cap enclosing panel 15 of the blank 10. The blank 10 may include additional fold lines with either the right cap enclosing panel 15 or the left cap enclosing panel including a third fold line 21*a*, a fourth fold line 21*b*, a fifth fold line 21*c*, a sixth fold line 21*d*, a seventh fold line 21*g*, an eighth fold line 21*h*, a ninth fold line 21*i*, and a tenth fold line 21*j*. Each of these fold lines may be positioned to enable specific folding movements that may transform the blank 10 from a substantially planar configuration into a three-dimensional carrier structure. The fold lines may be exercised in the machine of FIG. 5 using plows, stompers, and manipulators as described below with respect to FIG. 5 and FIGS. 10*a*-10H.

Figure 2A:
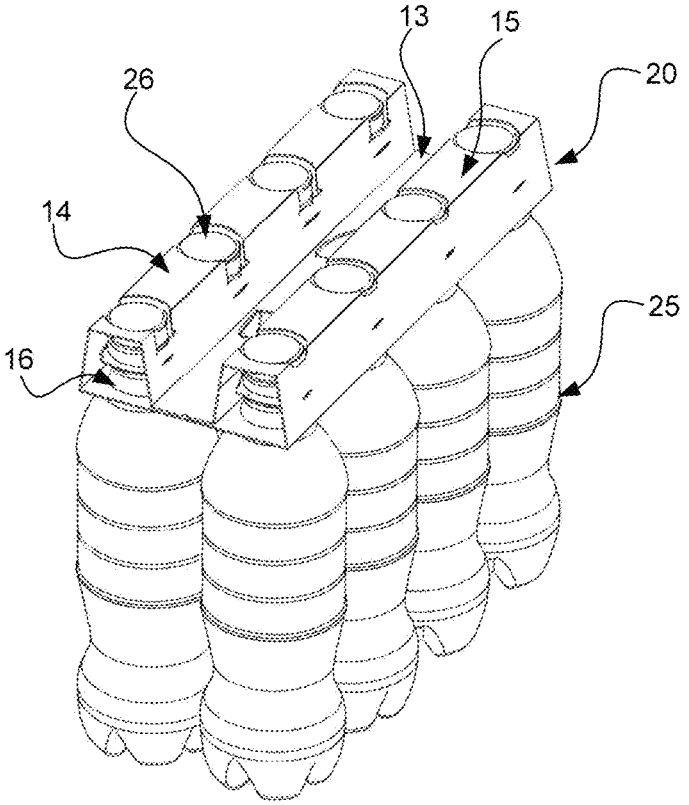
FIG. 2A depicts a perspective view of assembled carrier formed from the blank of FIG. 1 holding multiple containers according to an embodiment of the subject matter disclosed herein.

FIG. 2A depicts an assembled carrier formed from the blank of FIG. 1 holding multiple containers according to an embodiment of the subject matter disclosed herein. Referring to FIG. 2A, the construct 20 may be formed from the blank 10 of FIG. 1 into an assembled carrier configuration that may engage with a plurality of beverage containers 25. The construct 20 may be configured to hold the beverage containers 25 in a predetermined arrangement that may facilitate handling and transportation of the containers as a single unit. The beverage containers 25 may be positioned such that their caps 26 and/or neck regions may be received within the various orifices formed in the construct 20.

The central panel 13 of the construct 20 may serve as the primary structural foundation for supporting the beverage containers 25. The central panel 13 may be positioned substantially horizontally when the construct 20 may be in its assembled configuration. The container cap central panel orifices 16 formed in the central panel 13 may receive the caps 26 and/or neck regions of the beverage containers 25. Each container cap central panel orifice 16 may be sized to accommodate the diameter of a beverage container cap 26 and/or neck region while providing sufficient engagement to secure the container in position.

The left cap enclosing panel 14 may be folded along fold line 21*f* (see FIG. 1) to extend upwardly from the central panel 13. The left cap enclosing panel 14 may be positioned to cover a portion of the caps 26 and/or neck regions of the beverage containers 25 located on the left side of the construct 20. The container cap left panel orifices 17*a* formed in the left cap enclosing panel 14 may align with the caps 26 of the left side beverage containers when the panel may be in its folded position. The alignment of the container cap left panel orifices 17*a* with the container cap central panel orifices 16 may create a continuous opening that may accommodate the full height of the beverage container caps 26.

The right cap enclosing panel 15 may be similarly folded along fold line 21*e* to extend upwardly from the central panel 13. The right cap enclosing panel 15 may be positioned to cover a portion of the caps 26 of the beverage containers 25 located on the right side of the construct 20. The container cap right panel orifices 17*b* formed in the right cap enclosing panel 15 may align with the corresponding caps 26 and/or neck regions when the panel may be in its assembled position. The container cap right panel orifices 17*b* may work in conjunction with the container cap central panel orifices 16 to provide complete enclosure around the beverage container caps 26 and/or at least partial enclosure of the neck regions of the containers.

The left leading-edge tab 11*b* and right leading-edge tab 11*a* may be folded to provide structural support at the leading edges of the construct 20, although in FIG. 2 these features have been hidden for clarity. The tabs may be configured with fold lines that may allow them to be formed into rectangular support structures.

Figure 2B:
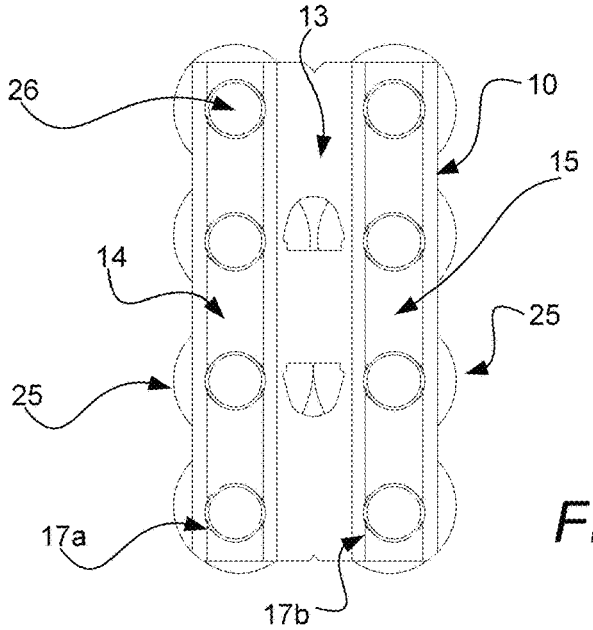
FIG. 2B shows a top view of the carrier of FIG. 2 according to an embodiment of the subject matter disclosed herein.

FIG. 2B shows a top view of the carrier of FIG. 2 according to an embodiment of the subject matter disclosed herein. Referring to FIG. 2B, the construct 20 may be viewed from above to show the final assembly configuration with eight beverage containers 25 engaged therein. The top view may reveal the spatial arrangement of the beverage containers 25 within the construct 20 and may illustrate how the various panels and orifices may work together to secure the containers in their designated positions. The eight beverage containers 25 may be arranged in a rectangular pattern with four containers positioned along each side of the construct 20.

The central panel 13 may be visible from the top view and may display the eight container cap central panel orifices 16 that may accommodate the caps 26 and/or neck regions of the beverage containers 25. The container cap central panel orifices 16 may be arranged in two parallel rows with four orifices in each row. The spacing between the orifices may be configured to match the standard spacing requirements for beverage container packaging. Each container cap central panel orifice 16 may be sized to provide a secure fit around the circumference of a beverage container cap 26 and/or neck region while allowing for easy insertion during the assembly process.

The left cap enclosing panel 14 may be folded over the central panel 13 and may cover the left portion of the beverage container caps 26. The container cap left panel orifices 17*a* formed in the left cap enclosing panel 14 may align with the container cap central panel orifices 16 to create continuous openings for the left side beverage containers. The alignment may ensure that the beverage container caps 26 and/or neck regions may be fully enclosed within the combined orifice structure formed by both panels.

The right cap enclosing panel 15 may be similarly positioned over the central panel 13 and may cover the right portion of the beverage container caps 26 and/or neck regions. The container cap right panel orifices 17*b* may align with the corresponding container cap central panel orifices 16 to provide an enclosure for the right side beverage containers. The overlapping configuration of the panels may create a secure engagement system that may prevent the beverage containers 25 from becoming dislodged during handling or transportation.

The first central panel finger holder orifice 18*a* and second central panel finger holder orifice 18*b* may be visible in the top view and may provide access points for manual handling of the complete package. The finger holder orifices may be positioned to allow a user to insert fingers through the openings and lift the entire assembly of the construct 20 and engaged beverage containers 25. The reinforcement provided by the overlapping panels may strengthen the finger holder orifices and may distribute the weight of the beverage containers 25 across multiple layers of material.

Figure 3:
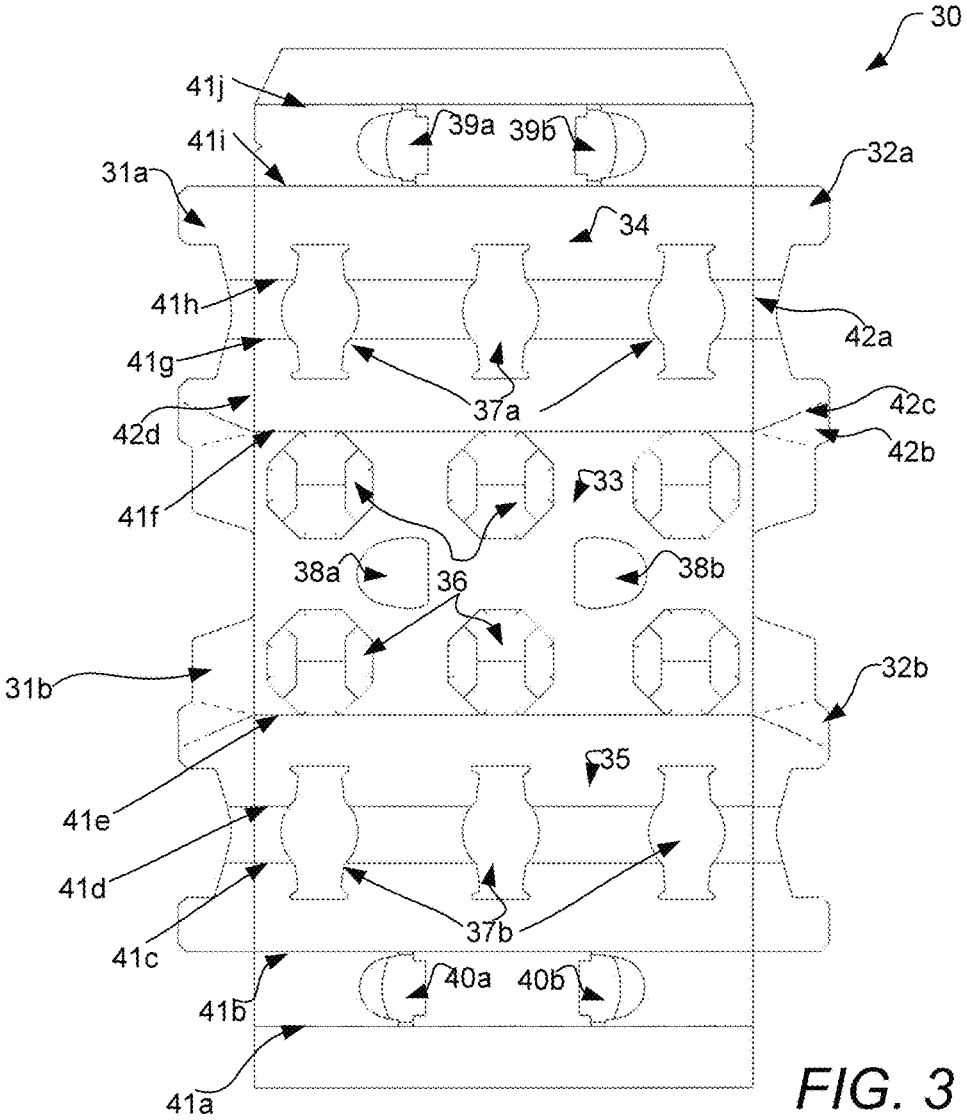
FIG. 3 illustrates a plan view of an alternative blank configuration for forming a carrier according to an embodiment of the subject matter disclosed herein.

FIG. 3 illustrates an alternative blank configuration with multiple openings and features according to an embodiment of the subject matter disclosed herein. FIG. 3 illustrates a flat blank 30 according to a second embodiment of the subject matter disclosed herein. The blank 30 may comprise a substantially planar sheet of material that may be configured to form a carrier for engaging with six beverage containers. The blank 30 may include a central panel 33 that may serve as a primary structural element of the carrier. The central panel 33 may be positioned substantially in the center of the blank 30 and may provide a foundation for supporting the articles when the blank 30 may be formed into a carrier configuration.

The blank 30 may include a left cap enclosing panel 34 and a right cap enclosing panel 35 that may be positioned adjacent to the central panel 33. The left cap enclosing panel 34 may be connected to the central panel 33 along a fold line 41*f* that may allow the left cap enclosing panel 34 to be folded relative to the central panel 33. The right cap enclosing panel 35 may be similarly connected to the central panel 33 along another fold line 41*e* that may permit folding movement of the right cap enclosing panel 35.

The central panel 33 may include a plurality of container cap central panel orifices 36 that may be configured to receive a portion of a beverage container cap. The container cap central panel orifices 36 may be sized and shaped to accommodate the cap of individual beverage containers when engaged with the blank 30. In this embodiment, there may be six orifices to accommodate six beverage containers. The orifices 36 may also include biasing flaps suited to be maneuvered within the opening of the orifice to slide over the top of the cap and securing the cap in the orifice when passing the cap threshold.

The left cap enclosing panel 34 may also include container cap left panel orifices 37*a* that may be positioned to align with beverage container caps when the blank 30 may be in an assembled configuration. Similarly, the right cap enclosing panel 35 may include container cap right panel orifices 37*b* that may similarly be positioned to receive or accommodate a beverage container cap when assembled.

The central panel 33 may further include a first central panel finger holder orifice 38*a* and a second central panel finger holder orifice 38*b*. The first and second central panel finger holder orifices 38*a* and 38*b* may be configured to provide a means for a person to lift the container with beverages engaged therein. To provide additional support and reinforcement for the finger holder orifices 38*a* and 38*b*, the left cap enclosing panel 34 may include a first left panel finger holder orifice 39*a* and a second left panel finger holder orifice 39*b*. When folded, the first left panel finger holder orifice 39*a* and second left panel finger holder orifice 39*b* may be disposed coincident with the central panel finger holder orifices 38*a* and 38*b*, respectively. Likewise, the right cap enclosing panel 35 may include a first right panel finger holder orifice 40*a* and a second right panel finger holder orifice 40*b*. When folded, the first right panel finger holder orifice 40*a* and second right panel finger holder orifice 40*b* may be disposed coincident with the central panel finger holder orifices 38*a* and 38*b*, respectively.

The blank 30 may include a right trailing tab 32*a* that may extend from one edge of the right cap enclosing panel 35. The right trailing tab 32*a* may be configured to provide structural support when the blank 30 may be formed into a constructed carrier. Fold lines 42*a*, 42*b*, and 42*c* may facilitate folding the right trailing-edge tab 32*a* to form a rectangular construct to provide support to this edge of the right cap enclosing panel 35. The blank 30 may also include a left trailing-edge tab 32*b* that may extend from an edge of the left cap enclosing panel 34 and may provide similar structural functionality to the left cap enclosing panel 34 when assembled.

The blank 30 may further include a right leading-edge tab 31*a* and a left leading-edge tab 31*b*. The right leading-edge tab 31*a* may be positioned at a leading edge of the right cap enclosing panel 35 and may be similarly configured with fold lines to form a construct to support the right cap enclosing panel 35. Likewise, the left leading-edge tab 31*b* may be positioned at a leading edge of the left cap enclosing panel 34 and may be similarly configured with fold lines to form a construct to support the left cap enclosing panel 34.

The blank 30 may include multiple fold lines that may facilitate the formation of the blank 30 into a three-dimensional carrier structure. A first fold line 41*e* may be positioned to define a boundary between the central panel 33 and the right cap enclosing panel 35 of the blank 30. A second fold line 41*f* may be positioned to allow folding movement between the central panel 33 and the left cap enclosing panel 34 of the blank 30. The blank 30 may include additional fold lines including a third fold line 41*a*, a fourth fold line 41*b*, a fifth fold line 41*c*, a sixth fold line 41*d*, a seventh fold line 41*g*, an eighth fold line 41*h*, a ninth fold line 41*i*, and a tenth fold line 41*j*. Each of these fold lines may be positioned to enable specific folding movements that may transform the blank 30 from a substantially planar configuration into a three-dimensional carrier structure.

Figure 4:
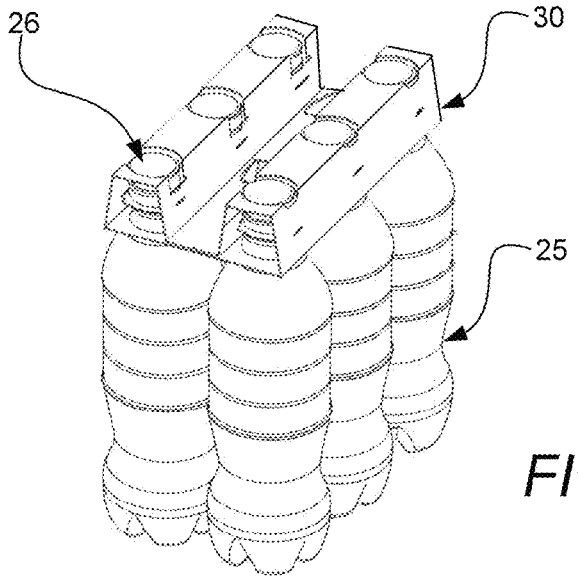
FIG. 4 depicts a perspective view of an assembled carrier formed from the blank of FIG. 3 holding multiple containers according to an embodiment of the subject matter disclosed herein.

FIG. 4 depicts an assembled carrier formed from the blank of FIG. 3 holding multiple containers according to an embodiment of the subject matter disclosed herein. Referring to FIG. 4, the construct 40 may be formed from the blank 30 of FIG. 3 into an assembled carrier configuration that may engage with a plurality of six beverage containers 25. The construct 40 may be configured to hold the beverage containers 25 in a predetermined arrangement that may facilitate handling and transportation of the containers as a single unit. The beverage containers 25 may be positioned such that their caps 26 may be received within the various orifices formed in the construct 40.

The central panel 33 of the construct 40 may serve as the primary structural foundation for supporting the six beverage containers 25. The central panel 33 may be positioned substantially horizontally when the construct 40 may be in its assembled configuration. The container cap central panel orifices 36 formed in the central panel 33 may receive the caps 26 of the beverage containers 25. Each container cap central panel orifice 36 may be sized to accommodate the diameter of a beverage container cap 26 while providing sufficient engagement to secure the container in position. The six container cap central panel orifices 36 may be arranged in a rectangular pattern with three orifices positioned along each side of the construct 40.

The left cap enclosing panel 34 may be folded along fold line 41*f* to extend upwardly from the central panel 33. The left cap enclosing panel 34 may be positioned to cover a portion of the caps 26 of the beverage containers 25 located on the left side of the construct 40. The container cap left panel orifices 37*a* formed in the left cap enclosing panel 34 may align with the caps 26 of the left side beverage containers when the panel may be in its folded position. The alignment of the container cap left panel orifices 37*a* with the container cap central panel orifices 36 may create a continuous opening that may accommodate the full height of the beverage container caps 26.

The right cap enclosing panel 35 may be similarly folded along fold line 41*e* to extend upwardly from the central panel 33. The right cap enclosing panel 35 may be positioned to cover a portion of the caps 26 of the beverage containers 25 located on the right side of the construct 40. The container cap right panel orifices 37*b* formed in the right cap enclosing panel 35 may align with the corresponding caps 26 when the panel may be in its assembled position. The container cap right panel orifices 37*b* may work in conjunction with the container cap central panel orifices 36 to provide complete enclosure around the beverage container caps 26.

The left leading-edge tab 31*b* and right leading-edge tab 31*a* may be folded to provide structural support at the leading edges of the construct 40. The tabs may be configured with fold lines that may allow them to be formed into rectangular support structures. The left trailing-edge tab 32*b* and right trailing-edge tab 32*a* may be similarly folded to provide structural reinforcement at the trailing edges of the construct 40. The trailing-edge tabs may be formed using fold lines 42*a*, 42*b*, and 42*c* to create three-dimensional support structures that may enhance the overall rigidity of the construct 40.

The first central panel finger holder orifice 38*a* and second central panel finger holder orifice 38*b* may be positioned to provide access points for manual handling of the complete package. The finger holder orifices may allow a user to insert fingers through the openings and lift the entire assembly of the construct 40 and engaged beverage containers 25. The first left panel finger holder orifice 39*a* and second left panel finger holder orifice 39*b* may align with the central panel finger holder orifices when the left cap enclosing panel 34 may be folded into position. Similarly, the first right panel finger holder orifice 40*a* and second right panel finger holder orifice 40*b* may align with the central panel finger holder orifices when the right cap enclosing panel 35 may be folded into position. The overlapping configuration of the finger holder orifices may provide reinforcement and may distribute the weight of the six beverage containers 25 across multiple layers of material.

Figure 5:
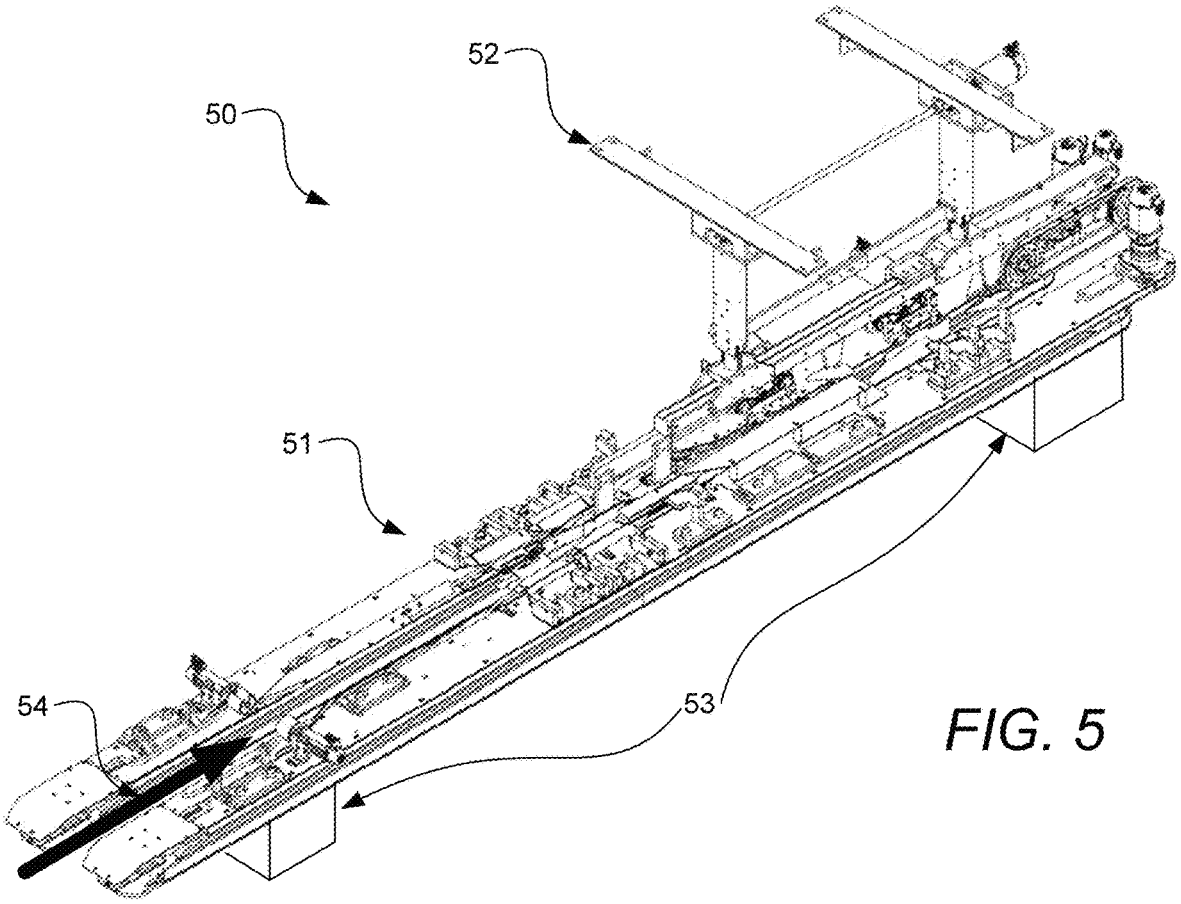
FIG. 5 depicts a perspective view of a portion of a machine for assembling the blanks of FIG. 1 or FIG. 3 with containers according to an embodiment of the subject matter disclosed herein.

FIG. 5 depicts a portion of a machine for assembling blanks of FIG. 1 or FIG. 3 with containers according to an embodiment of the subject matter disclosed herein. Referring to FIG. 5, the machine 50 may be configured to process blanks that have received a plurality of containers within the central panel and to complete processing of the construct according to the embodiments disclosed herein. The machine 50 may include a conveyance system 51 that initiates with a blank feeder 54 that may receive blanks that have at least partially received a plurality of containers. The conveyance system 51 is not shown for clarity in FIG. 5 and the machine 50 may be further supported by stanchions 53 and anchors 52. Further, additional portions of the machine 50 are not shown, such as a linear motor carousel that positions the containers, a blank feeder and an initial folding carousel that all work in conjunction with the portion of the machine 50 shown in FIG. 5.

Figure 6:
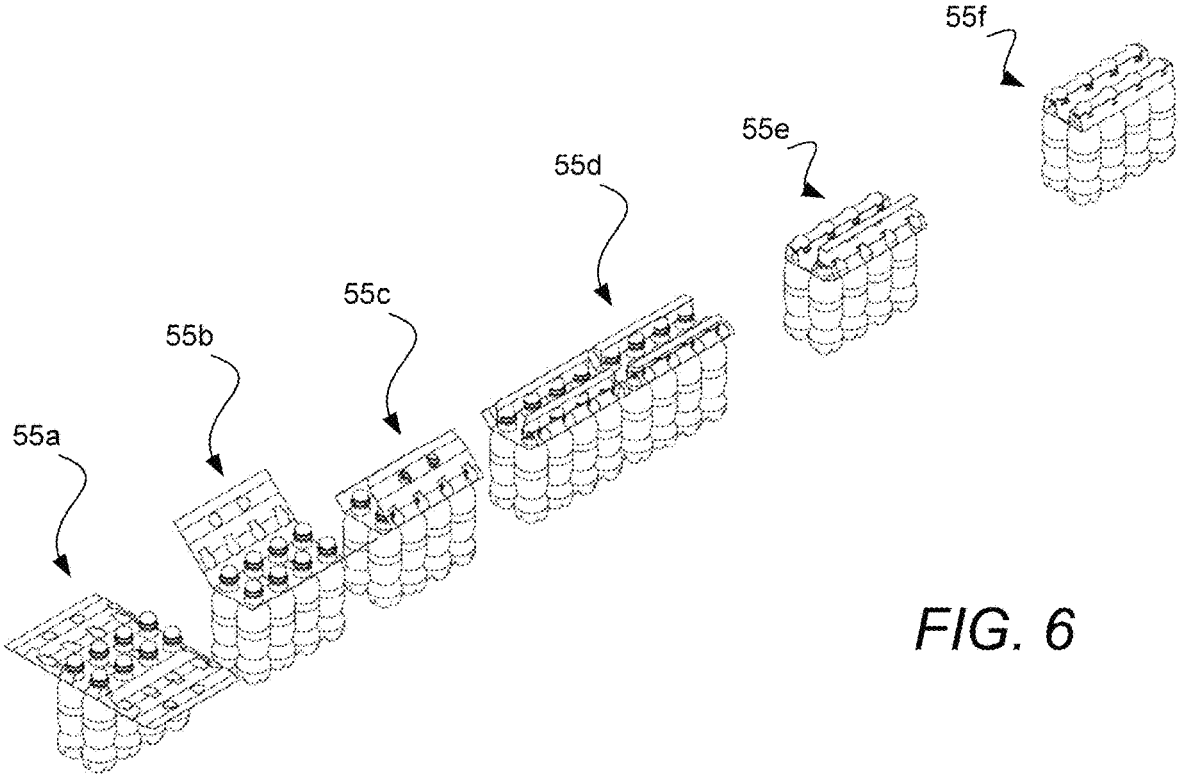
FIG. 6 shows a sequence of images of blanks during an assembly procedure using the machine of FIG. 5 in various stages of formation according to an embodiment of the subject matter disclosed herein.

FIG. 6 shows a sequence of images of blanks during an assembly procedure using the machine of FIG. 5 in various stages of formation according to an embodiment of the subject matter disclosed herein. Referring to FIG. 6, the conveyance system 51 may operate through a series of sequential stages that may transform flat blanks into assembled carriers engaged with beverage containers. The first stage may involve the blank feeder 54 receiving blank that includes a plurality of containers as shown in the first stage 55*a*. The blank may be oriented with its central panel positioned horizontally.

A preliminary stage may arrange and orient the beverage containers 25 and then position the containers such that their caps 26 and/or neck regions may be aligned with the container cap central panel orifices formed in the central panel of the blank. The containers may be pressed into engagement with the orifices such that the caps may pass through the openings and may be secured within the blank structure. A further stage of assembly (also not shown in the figures) includes partially folding the leading and trailing-edge tabs of the blank.

The second stage 55*b* may involve the activation of plow mechanisms that may begin the folding process of the blank. As is discussed in greater detail below, a first plow may engage with the left and right cap enclosing panels and may maneuver the panels upwardly from their initial flat position. The plow may apply controlled pressure to fold the left cap enclosing panel along its designated fold line. The left cap enclosing panel may be positioned to cover a portion of the beverage container caps located on the left side of the assembly.

The third stage 55*c* may comprise the operation of the second plow that may engage with the left and right cap enclosing panels. The second plow may position the left and right cap enclosing panels over the central panel. The fourth stage 55*d* involves a further set of plows to further manipulate panels to be ready for final enclosure with the beverage containers.

The fifth stage 55*e* may involve the simultaneous operation of right-side static guides and left side dynamic guides and stompers that may apply downward pressure to secure the left-side folded panels in their final positions. The stompers may use eccentric tooling to press the left cap enclosing panels firmly against the beverage container caps during progression of the assembly to ensure proper engagement. The stompers may also ensure that the container cap orifices in the side panels may be properly aligned with the central panel orifices to provide complete enclosure around the caps.

The sixth stage 55*f* may involve the simultaneous operation of right-side dynamic guides and stompers and with the right side of the package that may apply downward pressure to secure the right-side folded panels in their final positions. The stompers may use eccentric tooling to press the right cap enclosing panels firmly against the beverage container caps to ensure proper engagement. The stompers may also ensure that the container cap orifices in the side panels may be properly aligned with the central panel orifices to provide complete enclosure around the caps.

Figure 7:
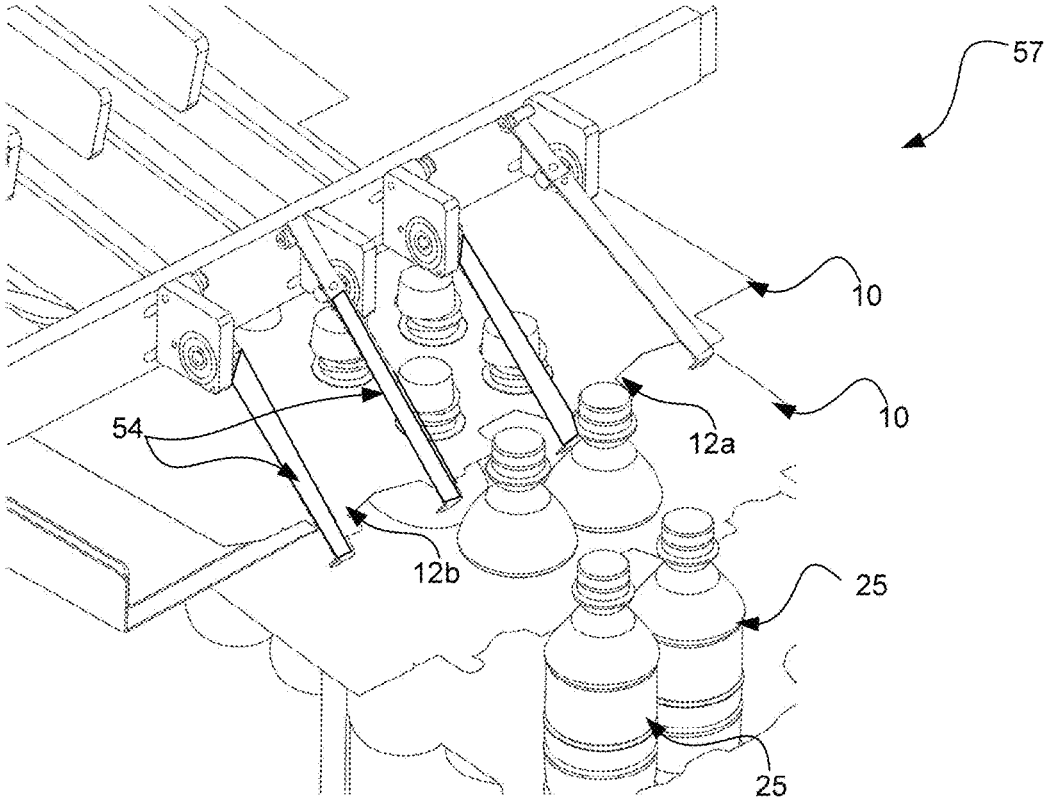
FIG. 7 depicts a portion of the machine of FIG. 5 showing an initial blank feeding stage wherein beverage containers are introduced and mechanisms perform a pre-break procedure on leading edges of each blank according to an embodiment of the subject matter disclosed herein.

Referring to FIG. 7, a pre-break procedure is illustrated wherein leading-edge manipulators 54 are shown performing a pre-break procedure on the leading-edge tabs 12*a* and 12*b* of a blank 10 as the blank assembly is fed into the machine 50. The leading-edge manipulators 54 may be positioned along the conveyance system 51 to engage with the leading-edge tabs 12*a* and 12*b* before the blank 10 may proceed to subsequent assembly stages. The pre-break procedure may be configured to initiate folding along fold line 22*a* within the leading-edge tabs 12*a* and 12*b* to facilitate proper formation of the tabs during later assembly operations.

The blank 10 may be conveyed through the machine 50 with the leading-edge tabs 12*a* and 12*b* positioned at the front edge of the blank relative to the direction of travel. The leading-edge tab 12*a* may extend from the left cap enclosing panel 14 and may include fold line 22*a* that may require pre-breaking to ensure proper subsequent folding. Similarly, the leading-edge tab 12*b* may extend from the right cap enclosing panel 15 and may include a corresponding fold line that may benefit from the pre-break procedure.

The leading-edge manipulators 54 may comprise mechanical elements that may be configured to apply controlled pressure or force to the leading-edge tabs 12*a* and 12*b*. The manipulators 54 may engage with the tabs 12*a* and 12*b* utilizing finger-like protrusions pointing downward at the ends of each manipulator 54. The pre-break procedure may involve applying sufficient force to partially crease or bend the leading-edge tabs at the fold line 22*a* without damaging the blank as the blank progresses forward. That is, when the leading-edge tabs 12*a* and 12*b* fold far enough, the finger-like protrusions will disengage the blank 10 as the blank 10 travels far enough along the propagation path.

Beverage containers 25 may be positioned beneath the blank 10 during the pre-break procedure and supported with tooling that moves at the same velocity as the blank. Tooling and/or the containers 25 may provide support for the blank 10 while the leading-edge manipulators 54 may perform the pre-breaking operation on the leading-edge tabs 12*a* and 12*b*. The tooling that supports the containers 25 may ensure that the blank 10 may remain stable during the manipulation of the leading-edge tabs.

The leading-edge manipulators 54 may be configured to operate simultaneously on both leading-edge tabs 12*a* and 12*b* to ensure uniform processing of the blank 10. The manipulators may apply pressure in a downward direction to create the initial fold along fold line 22*a* in leading-edge tab 12*a* and the corresponding fold line in leading-edge tab 12*b*. The pre-break procedure may create a weakened area along the fold line 22*a* that may facilitate easier and more precise folding during subsequent assembly operations. In some embodiments, there are four leading-edge manipulators 54 but in other embodiments this number may be more or fewer.

Figure 8:
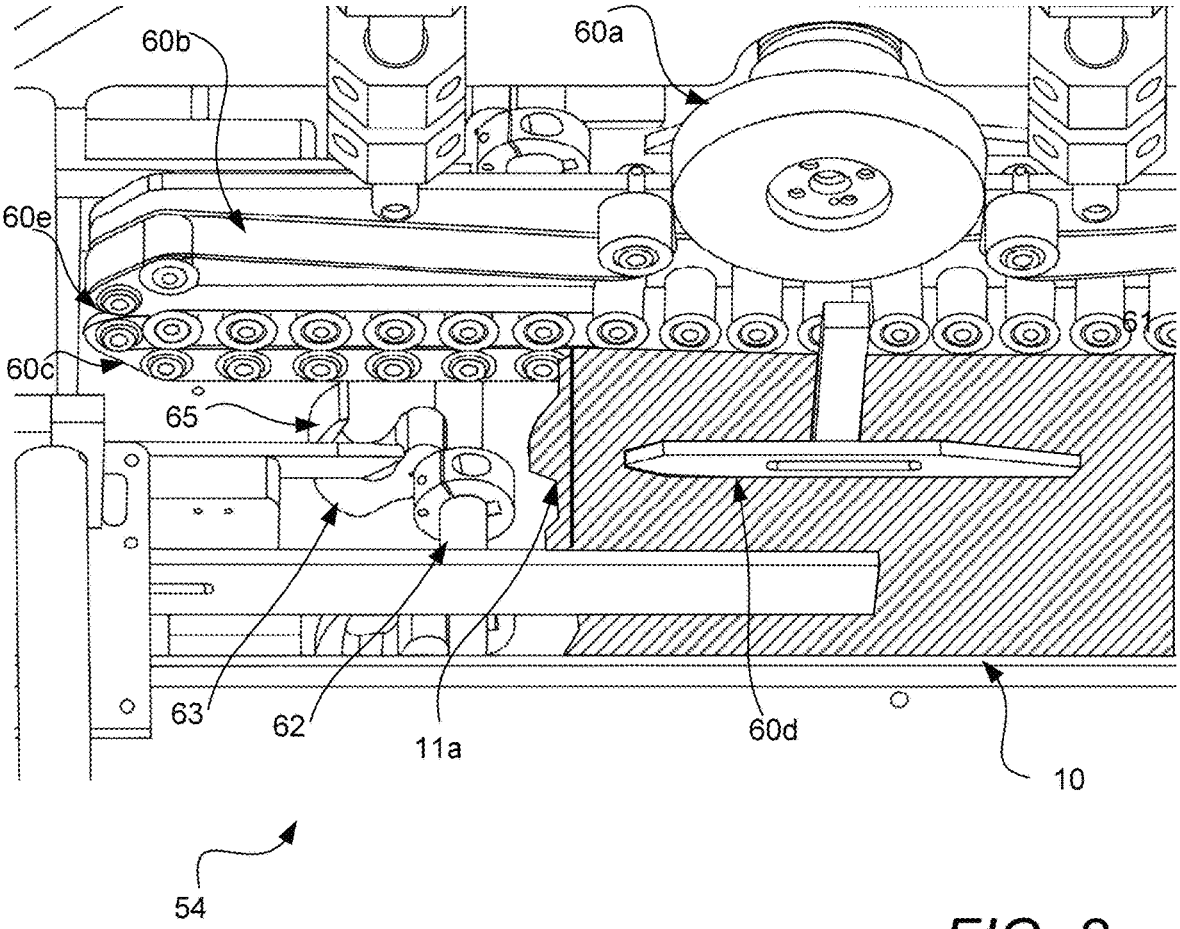
FIG. 8 depicts a portion of the machine of FIG. 5 showing a stage for manipulating trailing edges of the blanks to perform a pre-break procedure according to an embodiment of the subject matter disclosed herein.

Referring to FIG. 8, a portion of the machine 50 is shown in perspective to illustrate a trailing-edge pre-break procedure. As before, the overall construction of the carton formed from blank 10 may benefit from having the trailing-edge tabs 11*a* and 11*b* pre-broken for further manipulation is downstream procedures. The blank 10 may be engaged with beverage container caps at this point but are not illustrated here in order to show more clearly the trailing edge panel pre-break procedure. The blank may be propagated through this portion of the machine using two conveyor belts 60*b* and 60*c* that utilize a series of motorized wheels and an overall tension pully 60*a* to facilitate a pinch point 60*e* between belts 60*b* and 60*c*. The blank 10 is further supported by stabilizer 60*d* as it propagates through this section. In this reverse view, the blank 10 propagates from left to right such that the mechanism is arranged to fold the trailing-edge tabs 11*a* and 11*b*.

Dynamic cam 63 with engagement point 65 is actuated by rotation of dynamic cam shaft 62 which may rotate clockwise at varying speed. Engagement point 65 may engage trailing-edge tab 11*b* and may force the trailing-edge tab 11*b* upwards along fold line 22*d*. The prebreak procedure for trailing-edge tab 11*b* may commence when engagement point 65 may make initial contact with the underside surface of trailing-edge tab 11*b*. Dynamic cam 63 may continue rotating to apply progressive upward pressure against trailing-edge tab 11*b*. The upward force may cause trailing-edge tab 11*b* to begin bending along fold line 22*d*. The bending motion may create a partial separation of the material fibers along fold line 22*d* without completely severing the connection. Dynamic cam 63 may maintain contact with trailing-edge tab 11*b* throughout a predetermined arc of rotation. The engagement point 65 may follow a curved path that may gradually lift trailing-edge tab 11*b* to a predetermined angle (e.g., 120 degrees, as but one example) relative to the main body of the blank. The prebreak procedure may weaken the material along fold line 22*d* to facilitate subsequent folding operations. Upon completion of the prebreak cycle, dynamic cam 63 may disengage from trailing-edge tab 11*b* as the cam may continue its rotational motion. Note that a second dynamic cam (not shown in FIG. 8) may be attached to the same dynamic cam shaft 62 and may fold trailing-edge tab 11*a*.

Figure 9A:
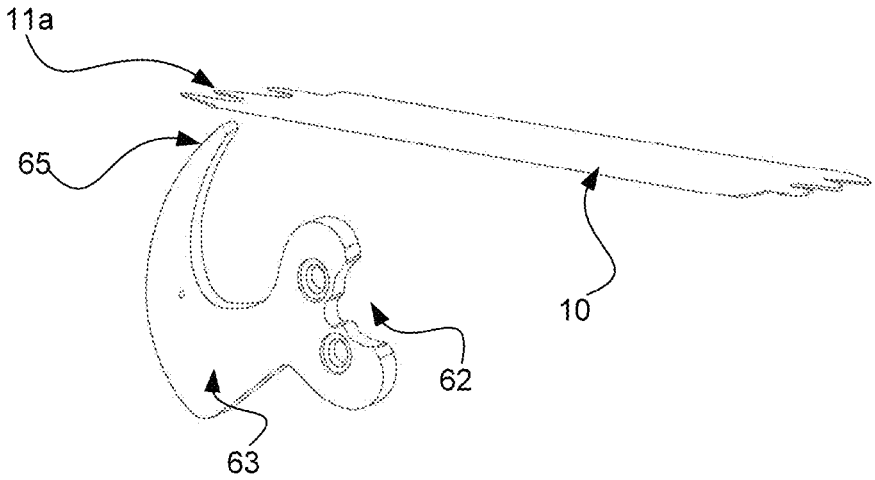
FIGS. 9A-9D illustrate the cam of FIG. 8 in various stages of a trailing edge pre-break procedure of a blank according to an embodiment of the subject matter disclosed herein.

FIG. 9A illustrates an initial stage of the trailing edge pre-break procedure wherein dynamic cam 63 may be positioned to engage with trailing-edge tab 11*a* (or 11*b*) of blank 10. The dynamic cam 63 may be mounted on dynamic cam shaft 62 and may be configured to rotate in a clockwise direction during the pre-break operation. The engagement point 65 of dynamic cam 63 may be positioned beneath trailing-edge tab 11*a* and may be oriented to make initial contact with the underside surface of the tab 11*a*. The blank 10 may be supported by the conveyance system during this stage to maintain proper positioning for the pre-break procedure.

The dynamic cam 63 may be configured with a curved profile that may allow engagement point 65 to follow a predetermined path during rotation. The engagement point 65 may be positioned at a specific location on the circumference of dynamic cam 63 to provide optimal contact with trailing-edge tab 11*a*. The dynamic cam shaft 62 may be connected to a drive mechanism (e.g., servomotor, stepper motor, AC motor, DC motor, linear motor, and the like) that may control the rotational speed and timing of the pre-break operation. The positioning of dynamic cam 63 relative to trailing-edge tab 11*a* may be calibrated to ensure proper engagement without causing damage to the blank material.

Figure 9B:
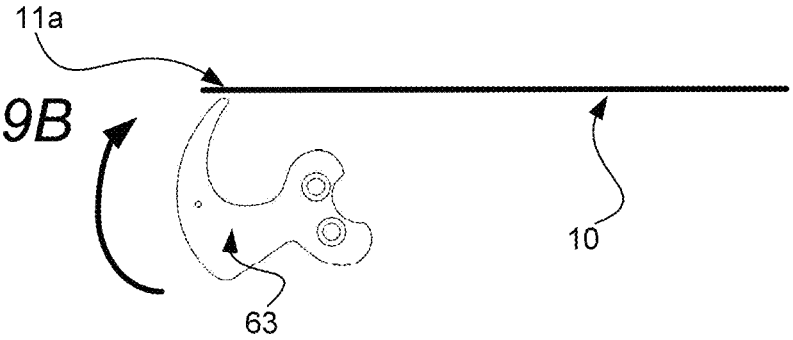

FIG. 9B depicts a subsequent stage of the trailing edge pre-break procedure wherein dynamic cam 63 may have rotated to bring engagement point 65 into contact with trailing-edge tab 11*a*. The rotation of dynamic cam 63 may cause engagement point 65 to apply upward pressure against the underside surface of trailing-edge tab 11*a*. The upward force may begin to bend trailing-edge tab 11*a* along fold line 22*d*. The bending motion may create initial stress concentration along the fold line without completely severing the material connection. This step may be performed at a first rotational velocity that achieve bending of the trailing-edge tab 11*a* while the blank is progressing forward.

The dynamic cam 63 may continue its rotational motion to maintain contact with trailing-edge tab 11*a* throughout a predetermined arc of rotation. The engagement point 65 may follow the curved profile of dynamic cam 63 to provide controlled lifting force against trailing-edge tab 11*a*. The upward pressure may be applied gradually to avoid sudden stress that could damage the blank material. The rotation speed of dynamic cam 63 may be coordinated with the conveyance speed of blank 10 to ensure proper timing and operation of the pre-break operation.

Figure 9C:
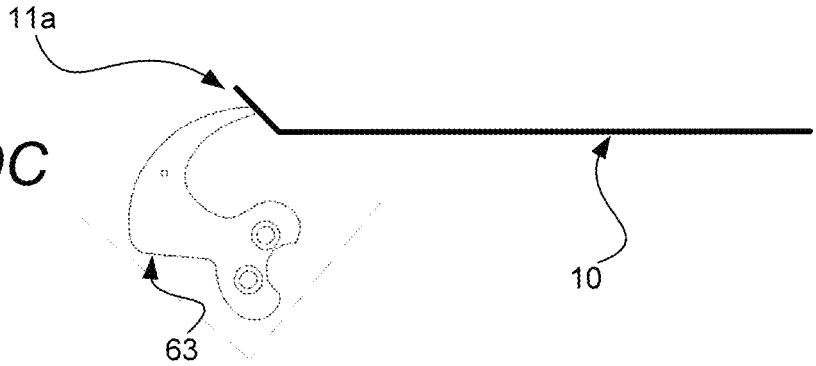

FIG. 9C illustrates a further stage of the trailing edge pre-break procedure wherein dynamic cam 63 may have rotated to a position where engagement point 65 may be applying an upward force against trailing-edge tab 11*a*. The trailing-edge tab 11*a* may be bent to a predetermined angle relative to the main body of blank 10. The bending motion may cause partial separation of the material fibers along fold line 22*d*. The pre-break procedure may weaken the material structure along the fold line to facilitate subsequent folding operations.

The engagement point 65 may maintain contact with trailing-edge tab 11*a* while dynamic cam 63 may continue its rotational motion. The upward force applied by engagement point 65 may continue to increase during this stage of the procedure. The bending angle of trailing-edge tab 11*a* may be controlled by the geometric and rotational velocity profiles of dynamic cam 63 and the position of engagement point 65. The pre-break operation may create a controlled weakening of the fold line without compromising the structural integrity of the blank.

Figure 9D:
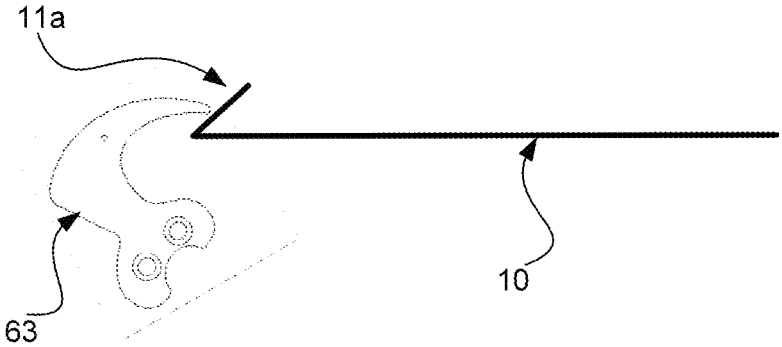

FIG. 9D shows a final stage of the trailing edge pre-break procedure wherein dynamic cam 63 may be completing its engagement cycle with trailing-edge tab 11*a*. The trailing-edge tab 11*a* may have been bent to its maximum predetermined angle during the pre-break operation. The engagement point 65 may be preparing to disengage from trailing-edge tab 11*a* as dynamic cam 63 may continue its rotational motion. During this stage of the prebreak operation the rotational velocity of the cam may be increased to cause the trailing-edge tab 11*a* to fold forward (the same direction of progression of the blank) which needs the cam to travel faster than the velocity of the blank. This velocity may be faster than the velocity of the previous operations. At the end of the prebreak procedure the velocity may very quickly go to zero to stop at the requisite prebreak angle which may be between 105 degrees and 170 degrees, between 110 degrees and 130 degrees or between 115 degrees and 125 degrees.

The pre-break procedure may be substantially complete at this stage with trailing-edge tab 11*a* having been weakened along fold line 22*d*. The dynamic cam 63 may continue rotating beyond this position to return engagement point 65 to its initial starting position for the next pre-break cycle. The trailing-edge tab 11*a* may retain its pre-broken condition to facilitate easier folding during subsequent assembly operations in the packaging system. As described above, second, third, fourth, etc. cams may be attached to the shaft to facilitate simultaneous breaking of trailing-edge tabs 11*a* and 11*b*.

FIGS. 10A-10E illustrate portions of the machine of FIG. 5 corresponding to the stages of assembly depicted in FIG. 6 without the blanks in the stages according to an embodiment of the subject matter disclosed herein. Likewise, FIGS. 11A-11E illustrate respective assembly stages of the blank as proceeding through the machine of FIG. 5 without the machine stage according to an embodiment of the subject matter disclosed herein.

FIG. 10A illustrates a portion of the machine 50 corresponding to the first stage 55*a* of assembly depicted in FIG. 6. The machine portion 60 may include two parallel rails 63*a* and 63*b* that may be positioned to guide and support blanks during the initial assembly stage. The rails 63*a* and 63*b* may be configured to maintain proper alignment of the blanks as they may be conveyed through the assembly process. The machine portion 60 may include mounting brackets 61*a* and 61*b* that may be positioned above the rails 63*a* and 63*b* respectively. The mounting brackets 61*a* and 61*b* may provide structural support for additional components that may be required during the assembly process. Two motorized actuators 62*a* and 62*b* may be positioned above and between the rails 63*a* and 63*b*. The motorized actuators 62*a* and 62*b* may serve as actuators to impart motion to tamper roller 64*a* and 64*b* that may apply controlled pressure or movement to blanks during the initial assembly stage. The motorized actuators 62*a* and 62*b* may be configured to operate in coordination with the conveyance system to ensure proper timing of assembly operations. The operation and tamping procedure utilizing the tamper roller 64*a* and 64*b* are discussed below with respect to FIGS. 12A-12D.

FIG. 11A depicts the first stage 55*a* of blank assembly wherein beverage containers 25 may be positioned engaged with a blank during the folding process. In this profile view, the blank shows trailing edge tabs 11*a* and 11*b* maneuvered to an upright position with respect to the plane of the blank 10. The upright position depicted may represent the trailing edge tabs 11*a* and 11*b* raised from the plan at 120-degree obtuse angle (e.g., a 60-degree acute angle) and ready for tamping as discussed next with respect to FIGS. 12A-12D.

Referring to FIG. 12A, the tamper wheel 64*a* may be positioned after the trailing-edge tab pre-break stage to further manipulate the leading-edge tab 12*a* and trailing-edge tab 11*a* of the blank 10. The tamper wheel 64*a* may include an outer rolling surface that may be arranged to roll across the blank 10 as the blank propagates through the system. The rolling surface of the tamper wheel 64*a* may be interrupted by a recess 66 that may be configured to align with the trailing-edge tab 11*a* during operation. The system may be configured to position the recess 66 in alignment with the trailing-edge tab 11*a* as the blank 10 moves through the tamper wheel stage.

The tamper wheel 64*a* may be mounted on a motorized actuator 62*a* that may control the rotational motion of the wheel. The motorized actuator 62*a* may be configured to match a rotational velocity of the tamper wheel 64*a* to a horizontal velocity of the blank 10 as the tamper wheel rolls across each blank. The synchronization of the rotational velocity with the horizontal velocity may ensure that the tamper wheel 64*a* maintains proper contact with the blank 10 without causing slippage or damage to the blank material.

Referring to FIG. 12B, the tamper wheel 64*a* may begin to engage with the leading-edge tab 12*a* as the blank 10 continues to propagate through the system. As the tamper wheel passes over the leading-edge tab 12*a*, the angle by which the leading-edge tab 12*a* was previously maneuvered is decreased and the pre-break line of weakening is reinforced by tamping. The system may be configured to monitor the position of the trailing-edge tab 11*a* relative to the recess 66 to ensure proper timing of the tamper operation. The tamper wheel 64*a* may maintain its synchronized rotational velocity with the horizontal velocity of the blank 10 during this stage of the operation.

Referring to FIG. 12C, the recess 66 of the tamper wheel 64*a* may begin to be at least partially aligned with the trailing-edge tab 11*a*. The system may be arranged to match the rotational velocity of the tamper wheel 64*a* to ensure that the trailing-edge tab 11*a* is aligned with the recess 66 when the tamper wheel engages the trailing-edge tab 11*a*.

Referring to FIG. 12D, the tamper wheel 64*a* may continue to operate at the rotational velocity while the recess 66 may be substantially aligned with the trailing-edge tab 11*a*. The matched rotational velocity allows for an alignment of the wedge-like recess 66 to "catch" the trailing-edge tab 11*a* and begin to tamp it down. The tamping engagement may cause the trailing-edge tab 11*a* to bend further about the fold line 22*d* beyond the angle achieved during the pre-break procedure.

Referring to FIG. 12E, the tamper wheel 64*a* may complete its engagement with the trailing-edge tab 11*a* as the recess 66 moves past the trailing-edge tab position. The system may be configured to maintain the rotational velocity of the tamper wheel 64*a* to match the horizontal velocity of the blank 10 after the trailing-edge tab 11*a* has been further manipulated. The trailing-edge tab 11*a* may retain its further bent configuration achieved through the tamper wheel operation. The tamper wheel 64*a* may continue to roll across the blank 10 with its synchronized velocity until the next blank may be encountered.

Figure 10B:
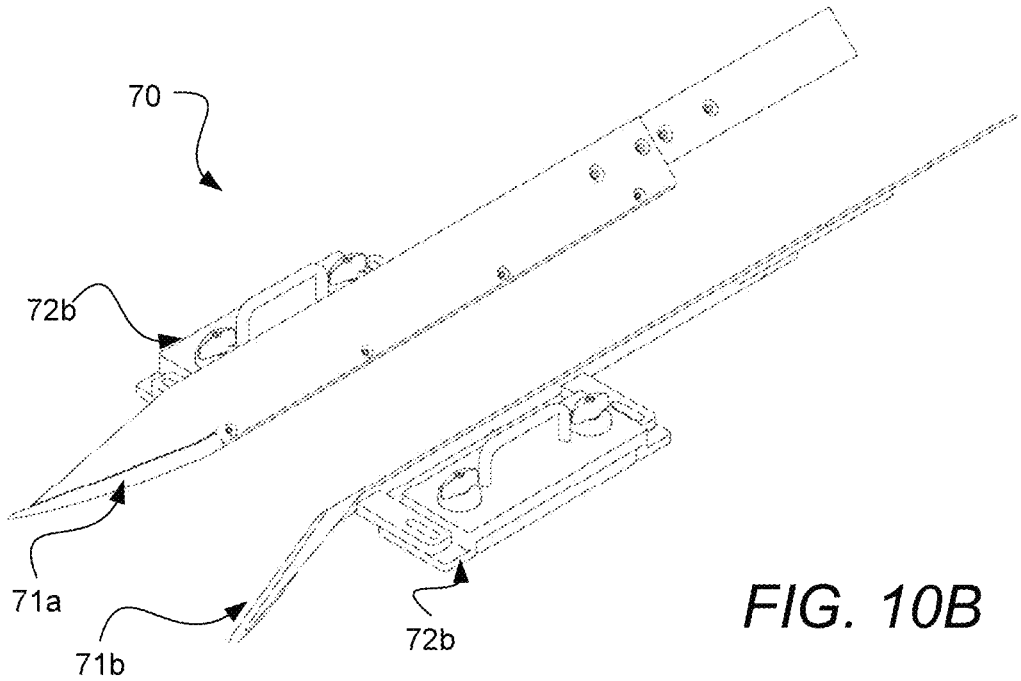

FIG. 10B illustrates a portion of the machine 50 corresponding to the second stage 55*b* of assembly depicted in FIG. 6. The machine portion 70 may comprise an elongated assembly that may be positioned at an angle relative to the conveyance system to facilitate the folding operations required during the second assembly stage. The machine portion 70 may include two plows 71*a* and 71*b* that may be positioned at a leading end of this portion. The plows 71*a* and 71*b* may be configured to engage with the left and right cap enclosing panels of blanks as they may be conveyed through this portion 70 of the assembly process. The machine portion 70 may include two elements 72*a* and 72*b* that may be positioned alongside the plows 71*a* and 71*b*. The elements 72*a* and 72*b* may serve as supports or anchors that may maintain proper positioning of the plows 71*a* and 71*b* during the manipulation operations.

Figure 11B:
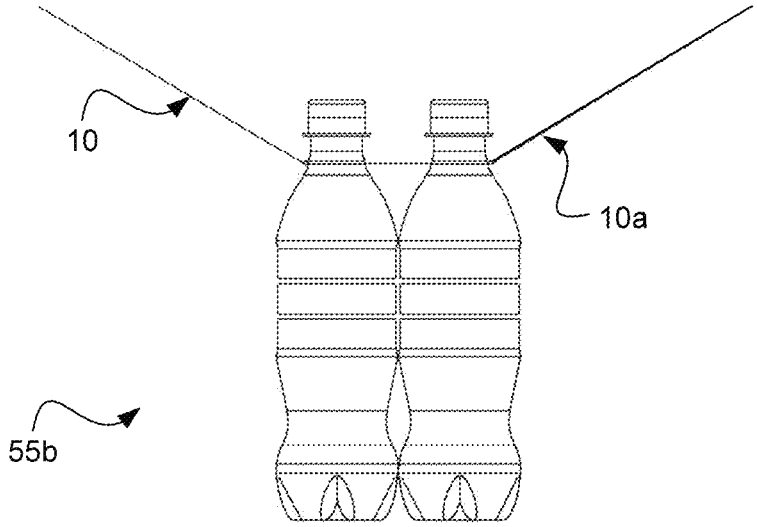

FIG. 11B depicts the second stage 55*b* of blank assembly wherein beverage containers 25 may be positioned vertically and may be engaged with a blank 10 during the folding process. The beverage containers 25 may be arranged side by side and may be secured within the container cap central panel orifices of the blank. The beverage containers 25 may be positioned with their caps extending through the container cap central panel orifices formed in the central panel of the blank. The containers may be held in a stable vertical orientation while the folding operations may be performed on the cap enclosing panels. In this depiction, the cap enclosing panels 10*a* are folded up (e.g., plowed) into a roughly 45-degree angle from the planer blank 10.

The second stage 55*b* may correspond to the point in the assembly process where the first plows 71*a* and 71*b* may begin engaging with the left and right cap enclosing panels of the blank. The cap enclosing panels may be maneuvered upwardly from their initial flat position to begin covering portions of the beverage container caps. The beverage containers 25 may remain in their vertical positions while the blank panels may be folded around them to create the assembled carrier configuration.

Figure 10C:
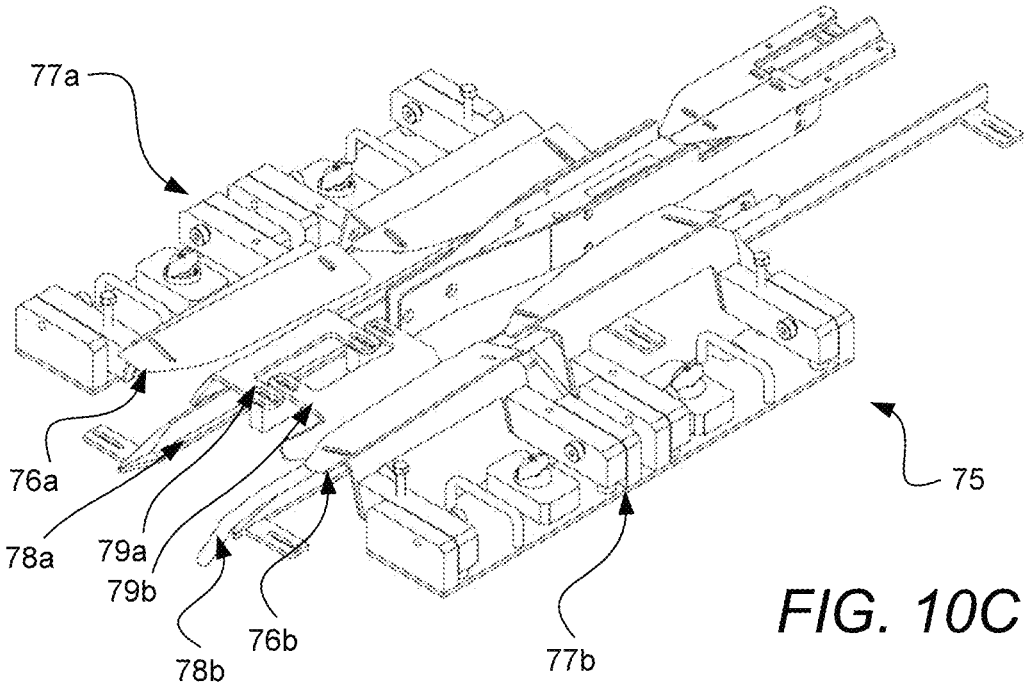

FIG. 10C illustrates a portion of the machine 50 corresponding to the third stage 55*c* of assembly depicted in FIG. 6. The machine portion 75 may comprise an assembly that may be configured to perform additional folding operations on the cap enclosing panels 10*a* of blanks during the third assembly stage. The assembly 75 may include multiple components that may be positioned to engage with different portions of the blanks 10 as they may be conveyed through this section of the packaging system.

The machine portion 75 may include a second plow assembly 76*a* that may be positioned on the left side of the conveyance path. The second plow assembly 76*a* may be configured to engage with the left cap enclosing panel of blanks 10 and may apply controlled pressure to continue the folding process initiated in the previous assembly stage. The second plow assembly 76*a* may include angled surfaces that may guide the left cap enclosing panel into its proper position relative to the central panel and engaged beverage containers.

A third plow assembly 76*b* may be positioned on the right side of the conveyance path and may be configured to engage with the right cap enclosing panel of blanks 10. The third plow assembly 76*b* may operate in coordination with the second plow assembly 76*a* to ensure simultaneous folding of both cap enclosing panels. The third plow assembly 76*b* may include similar angled surfaces that may guide the right cap enclosing panel into its designated position during the third assembly stage 55*c*.

The machine portion 75 may include guide rails 77*a* and 77*b* that may be positioned to maintain proper alignment of blanks as they may be conveyed through the third assembly stage. The guide rails 77*a* and 77*b* may be configured to prevent lateral movement of the blanks while allowing the folding operations to be performed on the cap enclosing panels. The guide rails 77*a* and 77*b* may be adjustable to accommodate blanks of different sizes or configurations.

A support structure may be positioned beneath the conveyance path and may be configured to provide structural stability for the machine portion 75. The support structure may include mounting points for the plow assemblies 76*a* and 76*b* and may ensure proper positioning of these components relative to the blanks being processed.

Figure 11C:
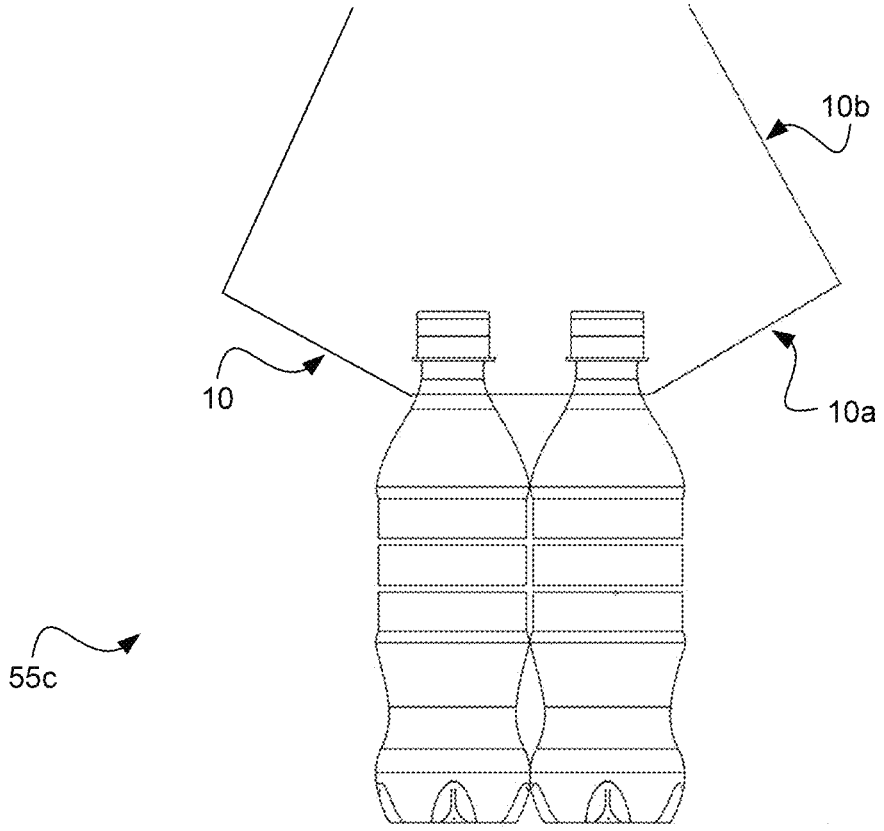

FIG. 11C depicts the third stage 55*c* of blank assembly wherein beverage containers 25 may be positioned vertically and may be engaged with a blank 10 during an advanced folding process. The beverage containers 25 may be arranged side by side and may be secured within the container cap central panel orifices of the blank. The containers 25 may be held in a stable vertical orientation while additional folding operations may be performed on the cap enclosing panels 10*a*-10*c*.

During further manipulation, the panel element may be further plowed to impart an additional fold angle in the respective left and right side of the blank 10. Thus, the panel 10*a* remains in the 45-degree angle from a previous stage 55*b* while an additional angle is imparted (e.g., plowed) for another portion 10*b* of each cap-enclosing panel. As such an approximate 90-degree angle is imparted to portion 10*b* with respect to portion 10*a*.

Figure 10D:
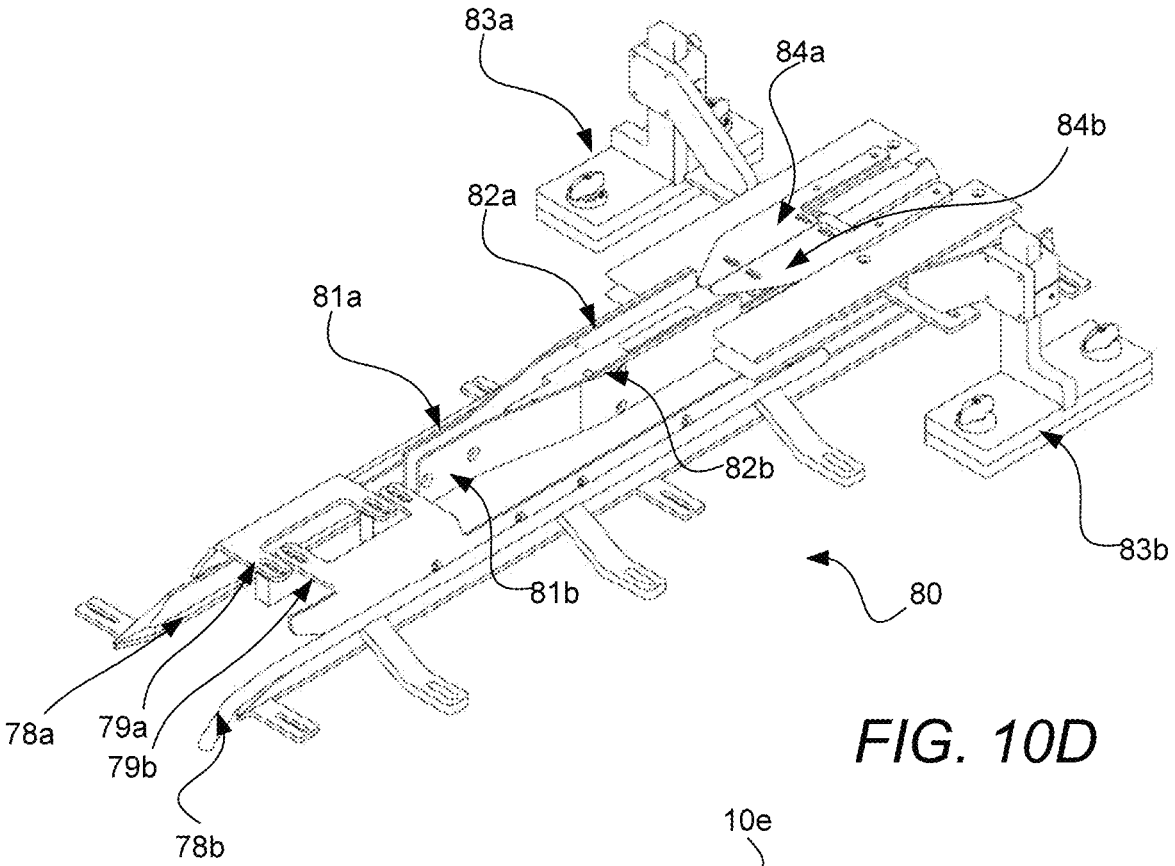

FIG. 10D illustrates a portion 80 of the machine 50 corresponding to the fourth stage 55*d* of assembly depicted in FIG. 6. The machine portion 80 may comprise an assembly that may be configured to perform advanced folding and positioning operations on blanks 10 during the fourth assembly stage 55*d*. The assembly 80 may include multiple components that may be positioned to engage with different portions of the blanks 10 as they may be conveyed through this section of the packaging system.

The machine portion 80 may include two main parallel tracks 81*a* and 81*b* that may be positioned to guide and support blanks 10 during the fourth assembly stage. The tracks 81*a* and 81*b* may be configured to maintain proper alignment of the blanks while allowing for complex folding operations to be performed on the cap enclosing panels. The left track 81*a* may include mounting points for various components that may engage with the left side of blanks during processing. Similarly, the right track 81*b* may include corresponding mounting points for components that may engage with the right side of blanks.

Figure 11D:
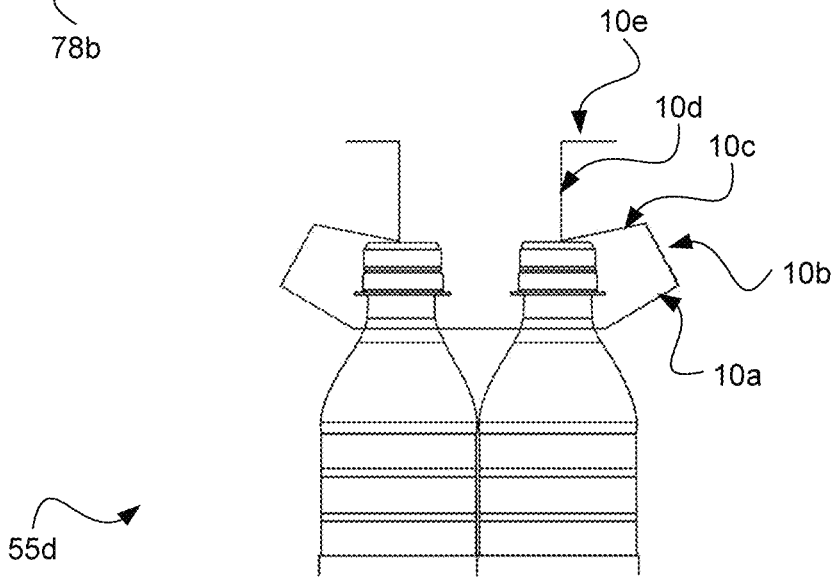

The machine portion 80 may include multiple plows 79*a*, 79*b*, 81*a*, 81*b*, 82*a*, 82*b*, 84*a* and 84*b* that may extend from the main tracks 81*a* and 81*b*. The configuration of these plows may impart additional shaping of the cap enclosing panels into a shape suited for the next stage. This shape includes panels 10*a*, 10*b*, 10*c*, 10*d*, and 10*e* as shown in FIG. 11D. Thus, plows 79*a* and 79*b* may impart folds to realize panel 10*c*, plows 81*a* and 81*b* may impart folds to realize panel 10*d*, and plows 84*a* and 84*b* may impart folds to realize panel 10*e*.

Three components 79*a*, and 79*b* may be positioned at the entry point of the machine portion 80 and may be configured to receive blanks from the previous assembly stage. The plows 79*a* and 79*b* may work in coordination to ensure proper alignment and orientation of blanks as they may enter the fourth assembly stage 55*d*. The components may include sensors or positioning mechanisms that may verify proper blank placement before subsequent operations may be performed. The machine portion 80 may include fixtures 83*a* and 83*b* that may be spaced along the length of the assembly to provide lateral support to the plows 79*a*, 79*b*, 81*a*, 81*b*, 82*a*, 82*b*, 84*a* and 84*b*.

FIG. 11D depicts the fourth stage 55*d* of blank assembly wherein beverage containers 25 may be positioned vertically and may be engaged with a blank 10 during advanced panel positioning operations. The beverage containers 25 may be arranged side by side and may be secured within the container cap central panel orifices of the blank. The containers may be held in a stable vertical orientation while complex folding operations may be performed on multiple panel sections of the blank. Each cap enclosing panel may be shaped by the aforementioned plows to realize the depicted shape of panels 10*a*, 10*b*, 10*c*, 10*d*, and 10*e*. This stage 55*d* now has the shaped panels suited for clipping in the next stage 55*e*.

Figure 10E:
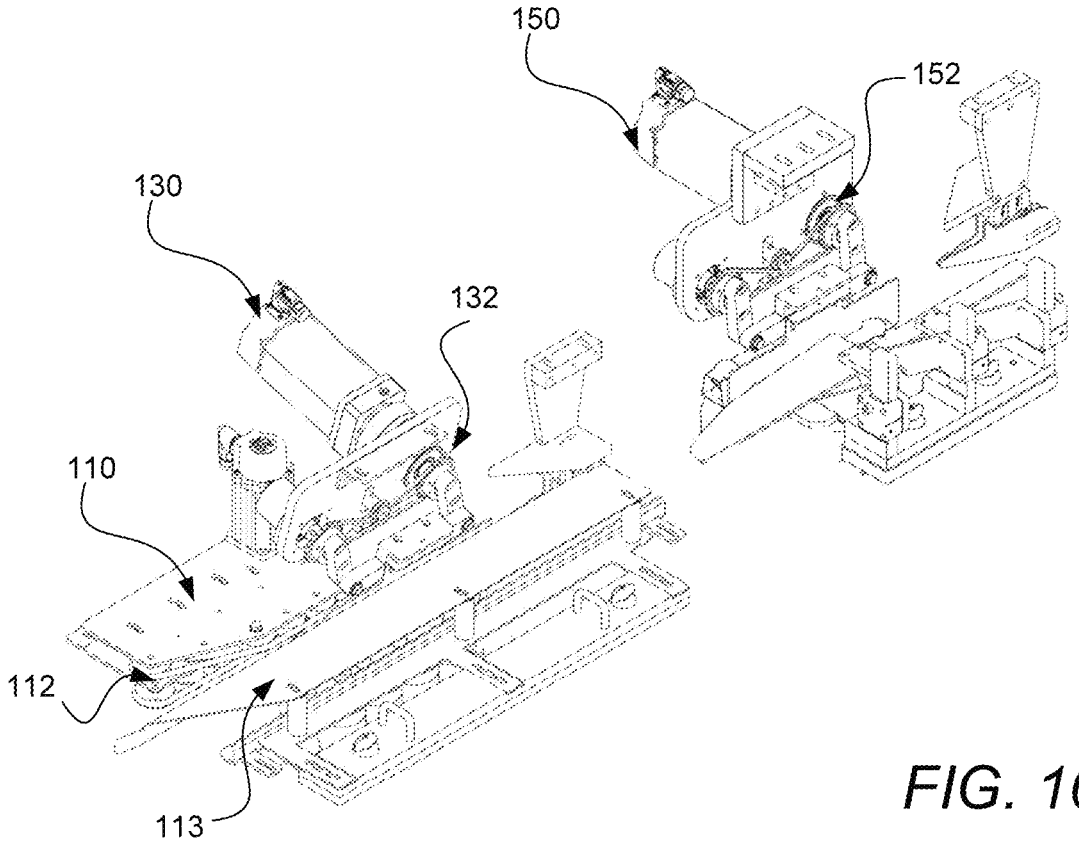

FIG. 10E illustrates a portion of the machine 50 corresponding to the fifth stage 55*e* of assembly depicted in FIG. 6. The machine portion may comprise a specialized dynamic guide 110 and latching tools 130 and 150 that may be configured to apply downward pressure to secure the left-side folded panels and right-side folded panels in their final positions during the fifth assembly stage 55*e*. The portion may include multiple directional components that may be positioned to engage with specific portions of the blanks 10 as they may be conveyed through this section of the packaging system.

In a first portion, the dynamic guide 110 may engage a left-side panel of a blank that is propagating through the machine along an exterior panel such panel 10*a* as depicted in FIG. 11D. In this manner, the left-side dynamic guide 110 holds the left clip enclosing panel in position while a left blade member that is part of a left-side latching tool 130 simultaneously secures the portion of the left clip enclosing panel to the containers (e.g., tucked under a neck portion) on the opposite side (e.g., the right-side containers). To assist with the holding, the dynamic guide 110 includes a belt 112 driven by internal motors at a velocity to match the propagation velocity of the engaged blank. That is, the belt 112 of the dynamic guide 110 is moving at the velocity and arranged to move the left clip enclosing panel into partial alignment with the first group of containers and to hold the left clip enclosing panel in position while the blank and the plurality of containers propagate at the velocity.

This area also includes a right static guide 113 arranged to hold the right clip enclosing panel (e.g., the opposite panel 10*a*) in place while the right-side latching tool 150 secures the portion of the right clip enclosing panel to the left-side containers. Each latching tool 130 and 150 may include respective actuator motors 132 and 152 for utilizing blade members to secure the clipping portions. The components are described in more detail below with respect to FIGS. 13A-13D.

Figure 11E:
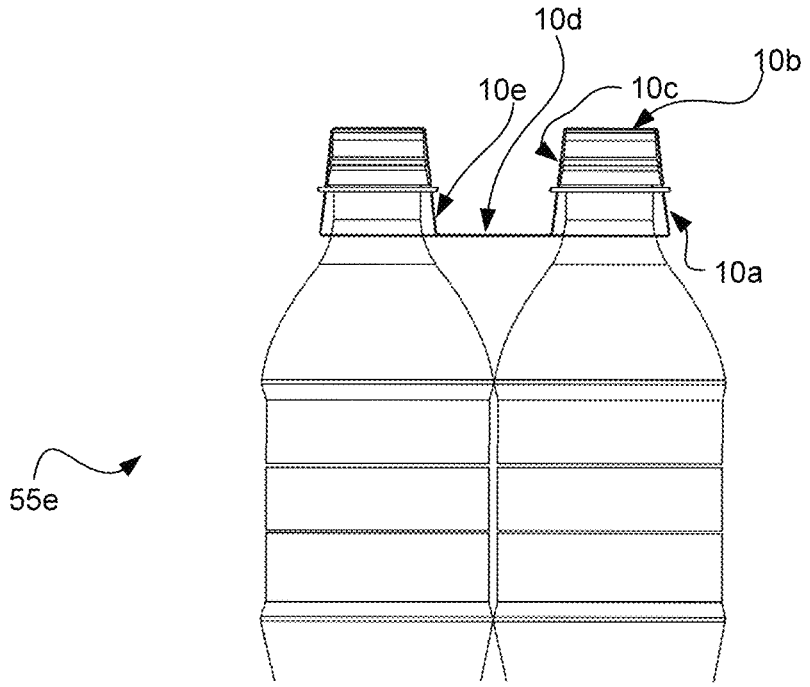

FIG. 11E depicts the fifth stage 55*e* of blank assembly wherein beverage containers may be positioned vertically and may be engaged with a blank during clip pressing and stomping operations. The beverage containers may be arranged side by side and may be secured within the container cap central panel orifices of the blank. The containers may be held in a stable vertical orientation while stomping pressure may be applied to the left-side and right-side panel sections to secure them in their final assembled configuration.

The assembly, now shown in its final assembled state, culminates with panel sections 10*a*, 10*b*, 10*c*, 10*d*, and 10*e* folded into secured positions. The panel sections 10*a*, 10*b* and 10*c* form an encapsulating section that surrounds the cap and neck regions of engaged containers 25. The panel 10*d* is now pressed down into the cavity between container cap and neck regions and panel 10*e* is pressed into secured alignment tucked under a neck region of an opposite side container(s). Likewise, the opposite side panels are arranged similarly with a corresponding panel 10*d* (not shown separately) pressed down into the cavity between container cap and neck regions and a corresponding second panel 10*e* (not shown separately) is pressed into secured alignment tucked under a neck region of the other opposite side container(s).

The fifth stage 55*e* may correspond to the point in the assembly process where the stomping mechanisms may apply controlled downward pressure to the left cap enclosing panel to ensure proper alignment and engagement with the beverage container caps. The stomping operation may press the left cap enclosing panel firmly against the container caps and/or neck regions of an opposite side set of containers to create a secure connection between the panel orifices and the container caps and/or neck regions. The pressure application may be calibrated to provide sufficient force to secure the panel without damaging the blank material or displacing the beverage containers from their designated positions.

Figure 13A:
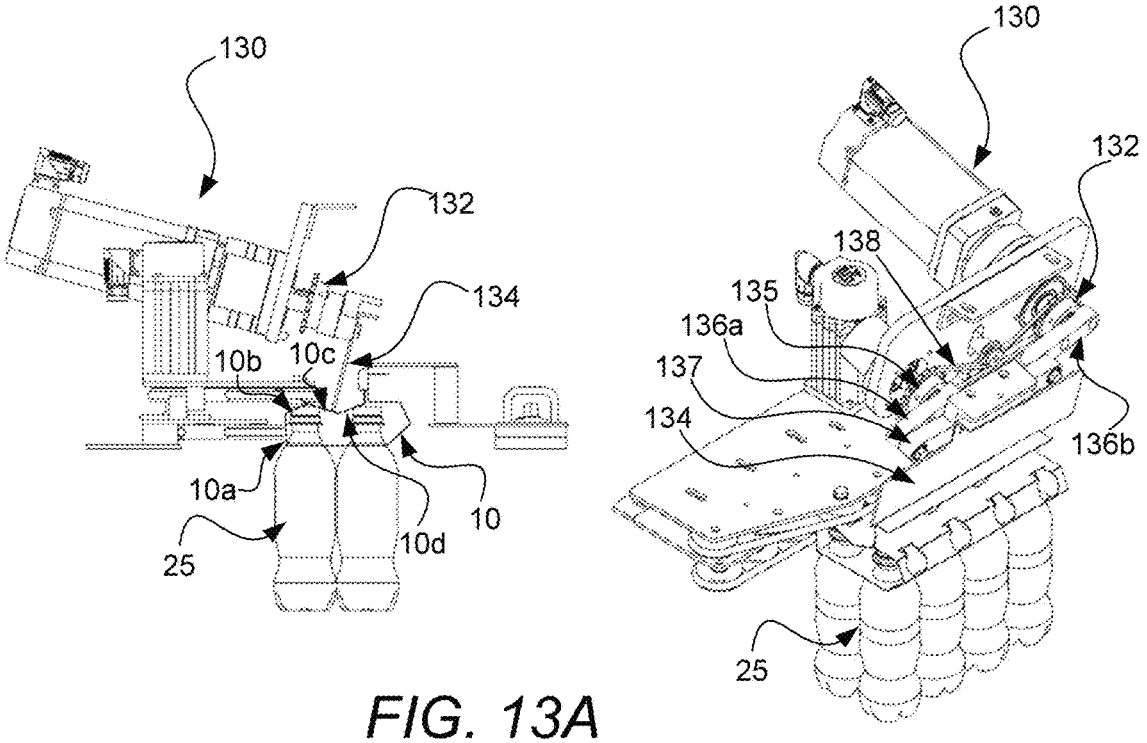
FIGS. 13A-13D illustrate aspects of the operation of the dynamic guide and latching tools of FIG. 10E in various stages of engagement with the blank according to an embodiment of the subject matter disclosed herein.

FIGS. 13A-13D illustrate aspects of the operation of the dynamic guide and latching tools of FIG. 10E in various stages of engagement with the blank according to an embodiment of the subject matter disclosed herein. Referring to FIG. 13A, the left latching tool 130 may be positioned to engage with a left clip enclosing panel of a blank during the fifth assembly stage 55*e*. The left latching tool 130 may include a left blade member 134 that may be configured to travel in an eccentric path during the latching operation. The left blade member 134 may be arranged to move vertically to secure a portion of the left clip enclosing panel to a first group of the plurality of containers while simultaneously moving horizontally at the first velocity that matches the propagation speed of the blank through the assembly system.

The left latching tool 130 may include a first arm 136*a* that may extend from a first base region to a first distal region. The first arm 136*a* may be pivotably mounted at the first base region to allow rotational movement during the latching operation. A second arm 136*b* may extend from a second base region to a second distal region and may be positioned parallel to the first arm 136*a*. The left blade member 134 may be pivotably coupled (via mount 137) between the first distal region of the first arm 136*a* and the second distal region of the second arm 136*b*. The pivotable coupling may allow the left blade member 134 to maintain proper orientation relative to the blank surface during the eccentric motion cycle.

The first arm 136*a* and the second arm 136*b* may be arranged to synchronously rotate about their respective first base region and second base region. The synchronous rotation may ensure that the left blade member 134 may follow a predetermined eccentric path that coordinates vertical and horizontal movement components. The first arm 136*a* may be coupled to a drive motor 132 that may provide the rotational power for the latching operation. The drive motor 132 may be configured to operate at variable speeds to accommodate different phases of the eccentric motion cycle.

The second arm 136*b* may be coupled to the first arm 136*a* via a belt 138 that may transmit rotational motion from the drive motor 132. The belt 138 may ensure that both arms rotate in synchronization to maintain proper blade member positioning throughout the latching cycle. The belt 138 may be configured with appropriate tension to prevent slippage during high-speed operations while allowing smooth power transmission between the arms.

Figure 13B:
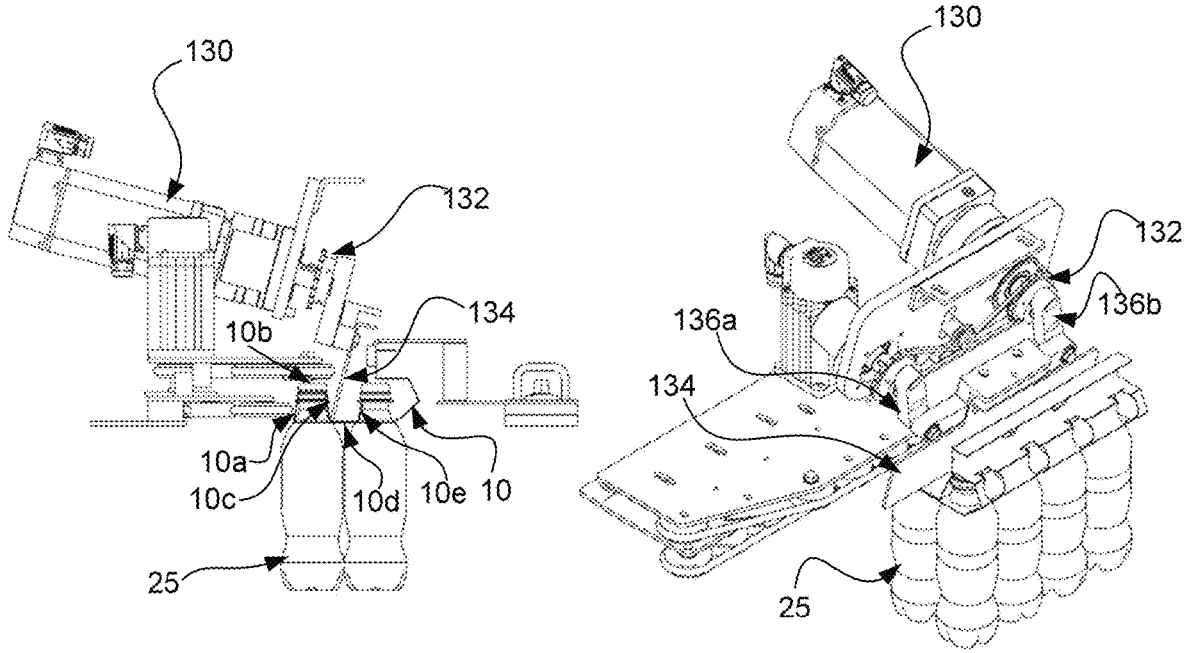

Referring to FIG. 13B, the left latching tool 130 may be shown in an intermediate position of the eccentric motion cycle. The left blade member 134 may be positioned to engage with panel section 10*e* of the left clip enclosing panel. The eccentric path of the left blade member 134 may cause the blade to approach the panel section 10*e* at an angle that facilitates proper insertion beneath the neck regions of the containers 25. The vertical component of the blade movement may allow the blade member 134 to lift the panel section 10*e* while the horizontal component may guide the panel into its secured position.

The drive motor 132 may continue to rotate the first arm 136*a* while the belt 137 may simultaneously rotate the second arm 136*b*. The coordinated rotation may cause the left blade member 134 to follow a curved trajectory that combines downward vertical motion with forward horizontal motion. The eccentric path may be calibrated to match the propagation velocity of the blank and containers through the assembly system to ensure proper timing of the latching operation.

Figure 13C:
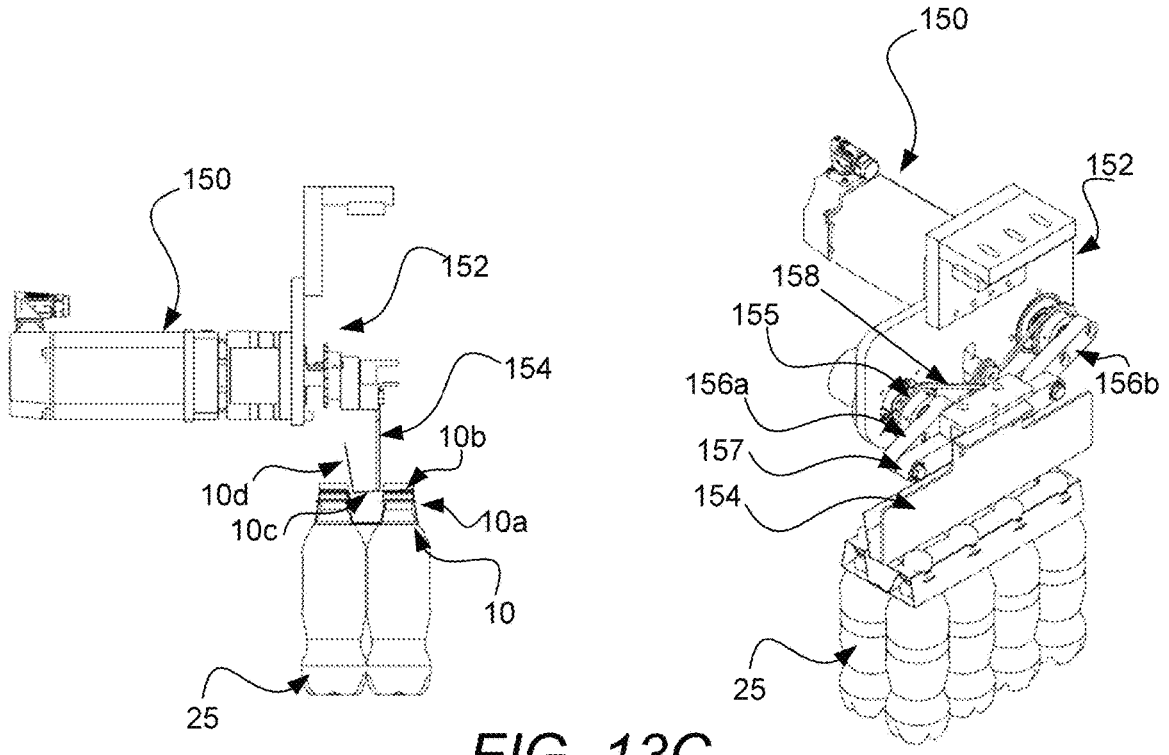

Referring to FIG. 13C, a right latching tool 150 may be positioned to engage with a right clip enclosing panel during the fifth assembly stage 55*e*. The right latching tool 150 may include a right blade member 154 that may be configured to travel in an eccentric path similar to the left blade member 134. The right blade member 154 may be arranged to move vertically to secure a portion of the right clip enclosing panel to a second group of the plurality of containers while simultaneously moving horizontally at the first velocity.

The right latching tool 150 may include a third arm 156*a* that may extend from a third base region to a third distal region. A fourth arm 156*b* may extend from a fourth base region to a fourth distal region and may be positioned to work in coordination with the third arm 156*a*. The right blade member 154 may be pivotably coupled between the third distal region of the third arm 156*a* and the fourth distal region of the fourth arm 156*b*. The coupling arrangement may allow the right blade member 154 to maintain proper angular orientation during the eccentric motion cycle.

The third arm 156*a* and the fourth arm 156*b* may be arranged to synchronously rotate about their respective base regions. The third arm 156*a* may be coupled to a second drive motor 152 that may provide rotational power for the right latching tool 150. The fourth arm 156*b* may be coupled to the third arm 156*a* via a second belt 158 that may transmit rotational motion to ensure synchronized operation of both arms.

Figure 13D:
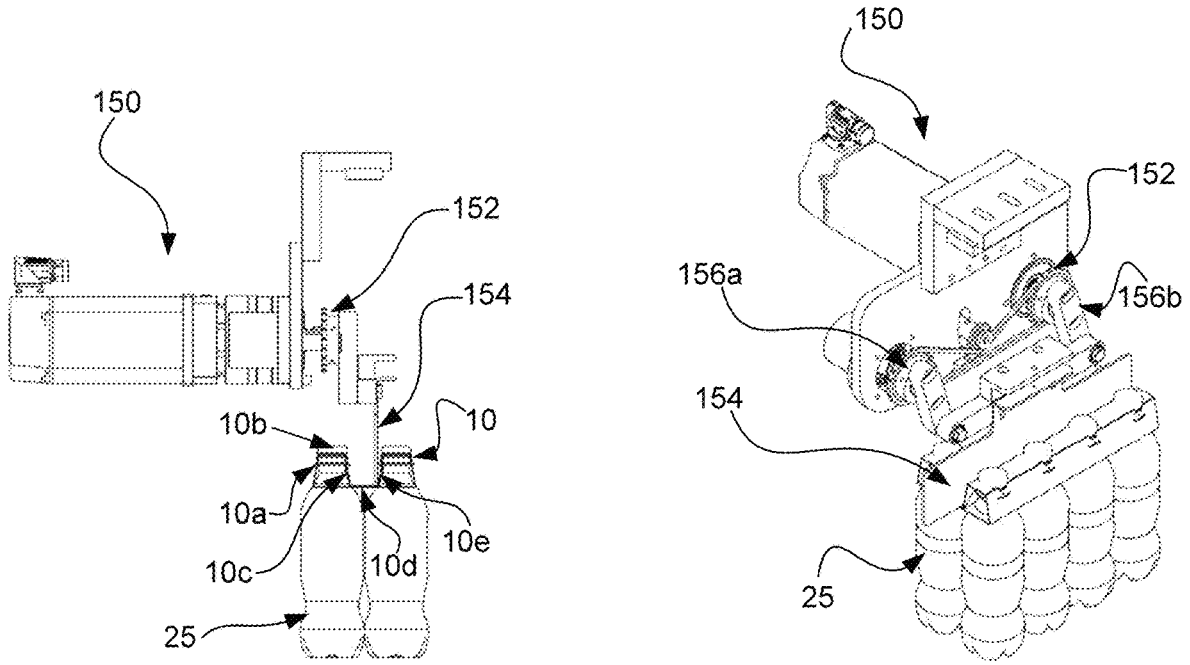

Referring to FIG. 13D, the right latching tool 150 may be shown in an intermediate position of the eccentric motion cycle. The right blade member 154 may be positioned to engage with panel section 10*e* of the right clip enclosing panel. The eccentric path of the right blade member 154 may cause the blade to approach the panel section 10*e* at an angle that facilitates proper insertion beneath the neck regions of the containers 25. The vertical component of the blade movement may allow the blade member 154 to lift the panel section 10*e* while the horizontal component may guide the panel into its secured position.

The coordinated operation of the left latching tool 130 and right latching tool 150 may ensure that both clip enclosing panels may be simultaneously secured to their respective container groups. The eccentric motion of both blade members may be timed to occur while the blank and containers may be propagating through the assembly system at velocity. The horizontal velocity component of each blade member may match the propagation velocity to maintain proper engagement with the moving blank throughout the latching operation.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Any of the features of the various embodiments of the disclosure can be combined with replaced by, or otherwise configured with other features of other embodiments of the disclosure without departing from the scope of this disclosure. The carrier styles and panel configurations described above are included by way of example.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

Terms "and," "or," and "and/or," as used herein, may include a variety of meanings that also is expected to depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein may be used to describe any feature, structure, or characteristic in the singular or may be used to describe some combination of features, structures, or characteristics. However, it should be noted that this is merely an illustrative example and claimed subject matter is not limited to this example. Furthermore, the term "at least one of" if used to associate a list, such as A, B, or C, can be interpreted to mean any combination of A, B, and/or C, such as A, B, C, AB, AC, BC, AA, AAB, ABC, AABBCCC, etc.

Reference throughout this specification to "one example," "an example," "certain examples," or "exemplary implementation" means that a particular feature, structure, or characteristic described in connection with the feature and/or example may be included in at least one feature and/or example of claimed subject matter. Thus, the appearances of the phrase "in one example," "an example," "in certain examples," "in certain implementations," or other like phrases in various places throughout this specification are not necessarily all referring to the same feature, example, and/or limitation. Furthermore, the particular features, structures, or characteristics may be combined in one or more examples and/or features.

In the preceding detailed description, numerous specific details have been set forth to provide a thorough understanding of claimed subject matter. However, it will be understood by those skilled in the art that claimed subject matter may be practiced without these specific details. In other instances, methods and apparatuses that would be known by one of ordinary skill have not been described in detail so as not to obscure claimed subject matter. Therefore, it is intended that claimed subject matter not be limited to the particular examples disclosed, but that such claimed subject matter may also include all aspects falling within the scope of appended claims, and equivalents thereof.

What is claimed:

1. A system for securing a blank to a plurality of containers, the system comprising:

a conveyor arranged to propagate the blank and the plurality of containers at a first velocity horizontally through the system, wherein the blank includes a main panel having a plurality of apertures, a left clip enclosing panel foldably coupled to a first side of the main panel and a right clip enclosing panel foldably coupled to a second side of the main panel, wherein each of the plurality of containers are at least partially received within a respective aperture of the plurality of apertures;

a left latching tool including a left blade member traveling in an eccentric path, the blade member arranged to move vertically to secure a portion of the left clip enclosing panel to a first group of the plurality of containers while simultaneously moving horizontally at the first velocity.

2. The system of claim 1, wherein the left latching tool includes:

a first arm extending from a first base region to a first distal region; and a second arm extending from a second base region to a second distal region;

wherein the left blade member is pivotably coupled between the first distal region and the second distal region.

3. The system of claim 2, wherein each of the first and the second arms are arranged to synchronously rotate about the respective first base region and second base region.

4. The system of claim 2, wherein the first arm is coupled to a drive motor and wherein the second arm is coupled to the second arm via a belt.

5. The system of claim 1, further comprising a left dynamic guide including a belt moving at the first velocity and arranged to move the left clip enclosing panel into partial alignment with the first group of containers and to hold the left clip enclosing panel in position while the blank and the plurality of containers propagate at the first velocity.

6. The system of claim 5, wherein the left dynamic guide holds the left clip enclosing panel in position while the left blade member simultaneously secures the portion of the left clip enclosing panel to the first group of the plurality of containers.

7. The system of claim 1, further comprising a right static guide arranged to hold the right clip enclosing panel in place while the blade member secures the portion of the left clip enclosing panel to the first group of the plurality of containers.

8. The system of claim 1, further comprising a right latching tool including a right blade member traveling in an eccentric path, the right blade member arranged to move vertically to secure a portion of the right clip enclosing panel to a second group of the plurality of containers while simultaneously moving horizontally at the first velocity.

9. A packaging system for securing a blank to a plurality of containers, the system comprising:

a conveyor arranged to propagate the blank and the plurality of containers at a first velocity horizontally through the system, wherein the blank includes a main panel having a plurality of apertures, a left clip enclosing panel foldably coupled to a first side of the main panel and a right clip enclosing panel foldably coupled to a second side of the main panel, wherein each of the plurality of containers are at least partially received within a respective aperture of the plurality of apertures;

a container feeding station configured to insert respective containers into respective apertures;

a left latching tool including a left blade member traveling in an eccentric path, the blade member arranged to move vertically to secure a portion of the left clip enclosing panel to a first group of the plurality of containers while simultaneously moving horizontally at the first velocity.

10. The packaging system of claim 9, wherein the left latching tool includes:

a first arm extending from a first base region to a first distal region; and a second arm extending from a second base region to a second distal region;

wherein the left blade member is pivotably coupled between the first distal region and the second distal region.

11. The packaging system of claim 10, wherein each of the first and the second arms are arranged to synchronously rotate about the respective first base region and second base region.

12. The packaging system of claim 10, wherein the first arm is coupled to a drive motor and wherein the second arm is coupled to the second arm via a belt.

13. The packaging system of claim 9, further comprising a left dynamic guide including a belt moving at the first velocity and arranged to move the left clip enclosing panel into partial alignment with the first group of containers and to hold the left clip enclosing panel in position while the blank and the plurality of containers propagate at the first velocity.

14. The packaging system of claim 13, wherein the left dynamic guide holds the left clip enclosing panel in position while the left blade member simultaneously secures the portion of the left clip enclosing panel to the first group of the plurality of containers.

15. The packaging system of claim 9, further comprising a right static guide arranged to hold the right clip enclosing panel in place while the blade member secures the portion of the left clip enclosing panel to the first group of the plurality of containers.

16. The packaging system of claim 9, further comprising a right latching tool including a right blade member traveling in an eccentric path, the right blade member arranged to move vertically to secure a portion of the right clip enclosing panel to a second group of the plurality of containers while simultaneously moving horizontally at the first velocity.

17. A method of forming a package comprising:

providing a blank comprising a main panel having a plurality of apertures, a left clip enclosing panel foldably coupled to a first side of the main panel and a right clip enclosing panel foldably coupled to a second side of the main panel;

inserting a plurality of containers into respective apertures of the plurality of apertures such that each container is at least partially received within a respective aperture;

propagating the blank and the plurality of containers at a first velocity horizontally through a packaging system;

securing a portion of the left clip enclosing panel to a first group of the plurality of containers using a left blade member that travels in an eccentric path while moving vertically and simultaneously moving horizontally at the first velocity.

18. The method of claim 17, wherein securing the portion of the left clip enclosing panel comprises:

rotating a first arm about a first base region;

rotating a second arm about a second base region synchronously with the first arm;

wherein the left blade member is pivotably coupled between a first distal region of the first arm and a second distal region of the second arm.

19. The method of claim 18, wherein rotating the first arm comprises driving the first arm with a drive motor and wherein rotating the second arm comprises transmitting rotational motion from the first arm to the second arm via a belt.

20. The method of claim 17, further comprising moving the left clip enclosing panel into partial alignment with the first group of containers using a left dynamic guide comprising a belt moving at the first velocity.

21. The method of claim 20, further comprising holding the left clip enclosing panel in position with the left dynamic guide while the left blade member simultaneously secures the portion of the left clip enclosing panel to the first group of the plurality of containers.

22. The method of claim 17, further comprising holding the right clip enclosing panel in place with a right static guide while the left blade member secures the portion of the left clip enclosing panel to the first group of the plurality of containers.

23. The method of claim 17, further comprising securing a portion of the right clip enclosing panel to a second group of the plurality of containers using a right blade member that travels in an eccentric path while moving vertically and simultaneously moving horizontally at the first velocity.

24. A method of forming a package comprising:

providing a blank comprising a main panel having a plurality of apertures, a left clip enclosing panel foldably coupled to a first side of the main panel and a right clip enclosing panel foldably coupled to a second side of the main panel;

feeding the blank through a container feeding station;

inserting respective containers into respective apertures at the container feeding station such that each container is at least partially received within a respective aperture;

propagating the blank and the plurality of containers at a first velocity horizontally through a packaging system;

securing a portion of the left clip enclosing panel to a first group of the plurality of containers using a left blade member that travels in an eccentric path while moving vertically and simultaneously moving horizontally at the first velocity.

25. The method of claim 24, wherein securing the portion of the left clip enclosing panel comprises:

rotating a first arm about a first base region;

rotating a second arm about a second base region synchronously with the first arm;

wherein the left blade member is pivotably coupled between a first distal region of the first arm and a second distal region of the second arm.

26. The method of claim 25, wherein rotating the first arm comprises driving the first arm with a drive motor and wherein rotating the second arm comprises transmitting rotational motion from the first arm to the second arm via a belt.

27. The method of claim 24, further comprising moving the left clip enclosing panel into partial alignment with the first group of containers using a left dynamic guide comprising a belt moving at the first velocity.

28. The method of claim 27, further comprising holding the left clip enclosing panel in position with the left dynamic guide while the left blade member simultaneously secures the portion of the left clip enclosing panel to the first group of the plurality of containers.

29. The method of claim 24, further comprising holding the right clip enclosing panel in place with a right static guide while the left blade member secures the portion of the left clip enclosing panel to the first group of the plurality of containers.

30. The method of claim 24, further comprising securing a portion of the right clip enclosing panel to a second group of the plurality of containers using a right blade member that travels in an eccentric path while moving vertically and simultaneously moving horizontally at the first velocity.

* * * * *